US006094166A

United States Patent [19]

Martek et al.

[11] Patent Number: 6,094,166

[45] Date of Patent: Jul. 25, 2000

[54] CONICAL OMNI-DIRECTIONAL COVERAGE MULTIBEAM ANTENNA WITH PARASITIC ELEMENTS

[75] Inventors: Gary Allen Martek, Kent; Todd Elson, Seattle, both of Wash.

[73] Assignee: Metawave Communications Corporation, Redmond, Wash.

[21] Appl. No.: 08/808,304

[22] Filed: Feb. 28, 1997

Related U.S. Application Data

[63] Continuation-in-part of application No. 08/680,992, Jul. 16, 1996, Pat. No. 5,940,048.

[51] Int. Cl.[7] ..... H01Q 3/02; H01Q 3/12

[52] U.S. Cl. ..... 342/374; 342/372; 342/375; 342/403; 342/406; 343/891; 343/893

[58] Field of Search ..... 342/375, 372, 342/373, 374, 361–366, 403, 406; 343/891, 893

[56] References Cited

U.S. PATENT DOCUMENTS

| | | | |
|---|---|---|---|
| 5,166,693 | 11/1992 | Nishikawa et al. | 342/422 |
| 5,440,318 | 8/1995 | Butland et al. | 343/814 |
| 5,543,807 | 8/1996 | Stangel | 342/374 |
| 5,552,798 | 9/1996 | Dietrich et al. | 343/893 |
| 5,570,546 | 11/1996 | Butterworth et al. . | |
| 5,629,713 | 5/1997 | Mailandt et al. | 343/808 |
| 5,771,025 | 6/1998 | Reece et al. | 343/828 |
| 5,861,844 | 1/1999 | Gilmore et al. | 342/374 |

*Primary Examiner*—Theodore M. Blum
*Attorney, Agent, or Firm*—Fulbright & Jaworski L.L.P.

[57] ABSTRACT

An omni directional coverage multibeam antenna relief on a ground surface having simple conical shapes to provide beam steering is disclosed. One advantage of such a system is that the projected area is always constant and broadside to the intended direction resulting in limited scan loss effects. In the case of a cylinder as the conical shape, z-axis symmetry provides a constant antenna aperture projection in any azimuthal direction. Using this geometry, high level, side lobes are reduced considerably because of the natural aperture tapering from dispersion effects. Coverage area and power can be controlled by changing the ground surface angle and by selectively activating different antenna beam positions around the circumference of the ground surface, and by selectively changing the phase relationship between a given set of antenna beams. Likewise, beam down-tilt may be electrically realized by providing a phase differentiated signal to different antenna sections associated with an antenna beam. Furthermore, modular circuitry may be utilized to provide different beam widths from a single antenna structure design.

50 Claims, 26 Drawing Sheets

FIG. 8b
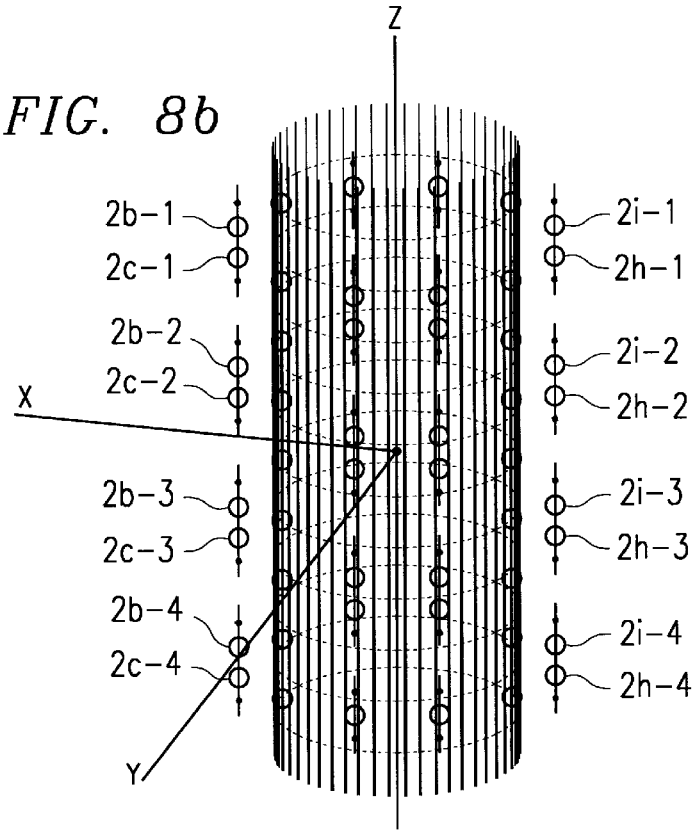
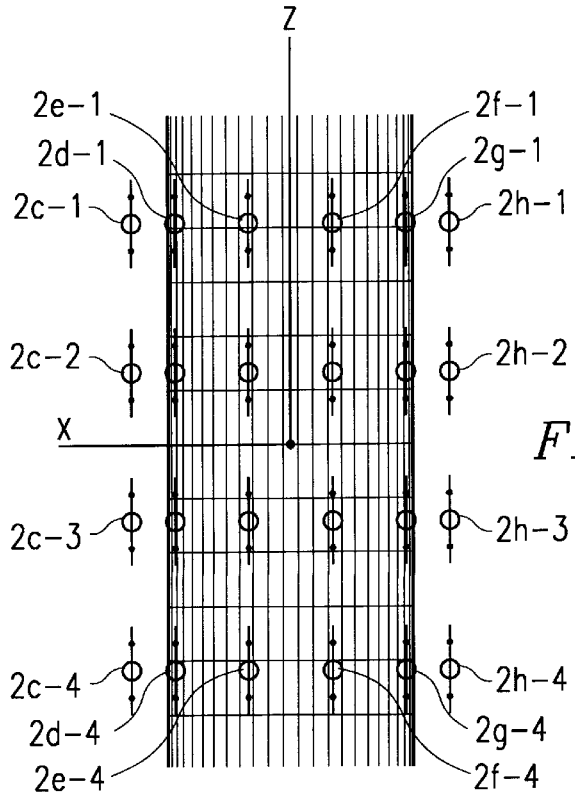
FIG. 8c

IDEALIZATION

DIODE SWITCHED CIRCUIT

CONICAL OMNI-DIRECTIONAL COVERAGE MULTIBEAM ANTENNA WITH PARASITIC ELEMENTS

REFERENCE TO RELATED APPLICATION

The present application is a continuation-in-part of co-pending and commonly assigned U.S. application Ser. No. #08/680,992, entitled "CONICAL OMNI-DIRECTIONAL COVERAGE MULTIBEAM ANTENNA," filed Jul. 16, 1996, now U.S. Pat. No. 5,940,048, and is related to co-pending and commonly assigned U.S. application Ser. No. #08/711,058, entitled "CONICAL OMNI-DIRECTIONAL COVERAGE MULTIBEAM ANTENNA WITH PARASITIC ELEMENTS," filed Sep. 9, 1996, now U.S. Pat. No. 5,872,547, each of which are incorporated herein by reference.

TECHNICAL FIELD OF THE INVENTION

This invention relates to coaxial cable fed multibeam array antennas and more particularly to antennas employing a conical shaped geometry to effect omni-directional composite coverage when all beams are superimposed.

BACKGROUND OF THE INVENTION

Planar array antennas, when imposed to cover multiple directions, suffer from scan loss. Since the projected aperture decreases as the beam is steered away from the broadside position which is normal to the ground surface and centered to the surface itself, it follows then that broadside excitation of a planar array yields maximum aperture projection. Accordingly, when such an antenna is made to come off the normal axis, the projected aperture area decreases causing a scan loss which is a function of cosine having a value 1 with the argument of zero radians (normal) and having a value 0 when the argument is $$\frac{\pi}{2}$$

$$\text{Ant Gain } db = 10\log\left[\frac{4\pi}{\lambda^2} * \text{Area} * \text{Cos}(\theta)\right]$$

There are a number of methods of beam steering using matrix type beam forming networks that can be made to adjust parameters as directed from a computer algorithm. This is the basis for adaptive arrays. When a linear planar array is excited uniformly (uniform aperture distribution) to produce a broadsided beam projection, the composite aperture distribution resembles a rectangular shape. When this shape is Fourier transformed in space, the resultant pattern is laden with high level side lobes relative to the main lobe. The $$\text{SIN}C = \frac{\text{SIN}(x)}{(x)}$$

function is thus produced in the far-field pattern. In most practical applications these high level side lobes are an undesirable side effect.

Furthermore, an array excited in this manner results in a radiation pattern having a front to back ratio insufficient to avoid co-channel interference with devices operating behind the array. As such reuse of a particular frequency radiating from the array is unnecessarily limited.

Accordingly, a need exists in the art for an antenna system which provides for beam steering without using adaptive techniques.

A further need exists in the art for such an antenna system whereby the beam aperture is relatively constant and broadside to its intended direction without producing undesirable high level side lobes.

A still further need exists in the art for an antenna system having a front to back ratio such that a frequency may be reused directly behind the antenna system without significant co-channel interference.

A yet further need exists in the art for an antenna system providing elevational "down-tilt" providing illumination of a predetermined area in order to allow frequency reuse by additional such antenna systems.

These and other objects and desires are achieved by an antenna design which relies on the simple geometry of conical shapes to provide a more natural beam steering.

SUMMARY OF THE INVENTION

In one embodiment of my invention, a transmit antenna is constructed as a series of antenna dipole columns mounted in close proximity to the outer surface of a nearby vertical conical shaped electrical ground surface. The ground surface is constructed circumferentially around a mast with a conical "slope" such that the ground surface "faces" downward at an angle, thereby creating on the ground a circumference within which the signal is propagated. This entire structure is contained within a single radome, which is transparent to radiated energy. This same circumferential columnar structure can be used for a separate receiver antenna array or one constructed within the same radome on the same mast as the transmit antenna and partitioned therefrom. The ground surface angle, or conical angle can be adjusted to contain or limit the coverage area of the intended radiation pattern.

When a group of columns are excited to create a beam, the positive result from this structure is created by the fact that the reflected "image" energy from the outer columns is dispersed when the radius of the ground surface cylinder is in the range of one wavelength ($\lambda$). When the various parallel ray paths are summed together to make the effective aperture distribution, the shape is close to a cosine function and the spatial transform is similar to a Gaussian shaped far-field pattern. This is true even with uniform aperture distribution across the array of antenna columns energized. Thus, the antenna system achieves lower side lobes in relation to the main lobe, which in most practical cases, is a desirable effect.

Accordingly, no modifications need be made to the outer array columns to effect side lobe level control as is the case with planar arrays. This is a significant improvement over prior art systems where it is common practice is to remove elements from the outer columns or to dissipate this energy into a resistive load to achieve the same amount of side lobe level control.

In one embodiment, the individual columns can consist of any type of radiator: patch, dipole, helical coil, etc. In the case of dipoles elevated above the grounded surface of the cylinder, the effect can be visualized as a circular patch being projected onto a curved surface where the reflected projection is an ellipse with the major axis of the ellipse being a function of the radius used to make up the cylinder. As that radius increases, the amount of dispersion decreases such that as the radius grows to infinity, the system behaves like the common linear planar array. The first side lobe grows in magnitude converging on the value of that seen with a uniformly excited linear array. So, the level of first side lobe leveling control is a function of the radius of the cylinder. Using this as the design objective, the radius of the preferred embodiment should be limited to a value of $$< \frac{3}{2} * \lambda.$$

In some applications, it is desirable to limit the radiation pattern of the antenna system so that a network of such systems can reuse an allocated set of frequencies repeatedly. The cylinder used as an example, could be replaced with a conic section that would be a "frustum of right circular cone." The larger radius of the two radii of the frustum, would be at the top, when mounted longitudinally. This would accommodate the "down-tilt" required for such a system. Other shapes can be used, such as right circular cones or semi-hemispheres to encompass airborne and space applications as well as terrestrial applications.

In addition, or in the alternative, to the above mentioned mechanical down-tilt, limiting of the radiation pattern may be accomplished through the use of elevational beam steering techniques. For example, a delay may be introduced in the signal provided to ones of the antenna elements forming an antenna column of the present invention. These delays set up a differential phase shift between the antenna elements. In the case where it is desired to have the antenna beam "look down" (down-tilt), the upper antenna elements of the column are advanced in phase. When this radiation is combined with the phase delayed energy of the lower portion of the column, the entire beam is steered down. Multiple angles of down-tilt are accomplished by having the appropriate number of selectable delays.

Beam width and gain are functions of how many radiator columns are driven at the same time from one excitation source. Any number of columns can be excited to effect the desired beam synthesis. The only requirement is that the active (excited) columns, can "see" the projected wave front that they are to participate in. This would determine the maximum number of columns required to effect a specific beam synthesis. The highest gain, narrowest beam is produced when all Pi radian active elements that are driven together can "see" the wave front that they are each to participate in. In the case of a cylinder, these would be the columns that are Pi apart on the circumference. A line drawn between the most outer and most inner columns, sets up the basis upon which the inner columns are phase retarded in order to produce the desired beam synthesis. However, a simulcast on all beams is possible if all "N" ports are excited at the same time.

The intended beam design objectives are based on the number of available adjacent columns to be excited. The narrower the beam, the more columns must be excited, and the more complex the phase retardation network. The simplest approach, is to disregard the image sources projecting off the ground surface and simply introduce the appropriate amount of phase shift on the inner columns to effect a "coherent" phase front in the direction of beam propagation. In this first approach, this works to create a useful pattern. However, the best gain and side lobe relationship is achieved when image source dispersion is taken into account. After the image sources have been adjusted for dispersion factor and ray trace length, a composite delay is assigned to the inner columns.

For example, assuming four columns are to be excited to create a beam, these four columns would be excited by a source that is applied to the appropriate beam input port. In order to introduce the proper amount of delay to result in a coherent phase front, this signal may be routed through an in-phase splitter. Then, the outputs of this splitter could again be split through the use of either another in-phase splitter or a 90 degree hybrid splitter. The outputs of these go to the antenna columns that make up the four excited columns. This feed topology, one embodiment of which forms a feed "ring," provides for the inner columns being connected to the phase delayed path having the proper amount of delay to result in a coherent beam, while the outer columns are not phase retarded.

As it may be desirable to be able to widen or narrow the beam, depending on what the service requires, it is possible to have two or more such beam width selections from one antenna structure according to the present invention. For example, three different feed rings, i.e., feed networks having a different number of antenna columns excited by an input signal, could provide three different beam widths based on service needs. As beam width is wider when fewer columns are excited, the beam width associated with the feed rings is a function of how many columns are excited by its particular signal paths. Therefore, each feed ring could be designed so as to create a beam of specified width (having predetermined 3 dB half power points). For example, 90°, 60°, 45°, and 30° beams could be arranged by feed rings having the appropriate topologies.

Accordingly, it is one technical advantage of my invention to provide an antenna system which relies on conical shaping of its ground surface and radiator positions above this ground to eliminate the effects of scan loss.

A further technical advantage of my invention is to construct an antenna array where dispersion effects of the image sources are used to effect first side lobe level control.

A still further technical advantage of my invention is a methodology for designing antenna radiator feed networks that are used to phase delay specific radiator columns to effect far field pattern synthesis.

An even further technical advantage of my invention is the use of a "frustum of a right circular cone" (a right circular cone with its tip blunted), which allows the system to create "down-tilt" where the radiation pattern has to be controlled for spectrum reuse.

An additional technical advantage of my invention is a methodology for designing antenna radiator feed networks that are used to phase delay specific antenna elements associated with radiator columns to effect elevational beam steering allowing the system to create down-tilt electrically.

Another technical advantage of my invention is a methodology for designing antenna radiator feed networks that provide for selectable antenna beam widths in an antenna system.

A further technical advantage of my invention is to construct the edges of the conic shape to effect elevation surface side lobe level control, thereby positioning destructive nulls into harmless areas away from the intended service area. In an alternate method and system, such nulls can be reduced by use of a combination of rounded edges and energy dissipative material.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIGS. 8*a*–8*c* are wire views of the model used for the method of moments radiation calculations;

DESCRIPTION OF THE PREFERRED EMBODIMENTS

Figure 1:
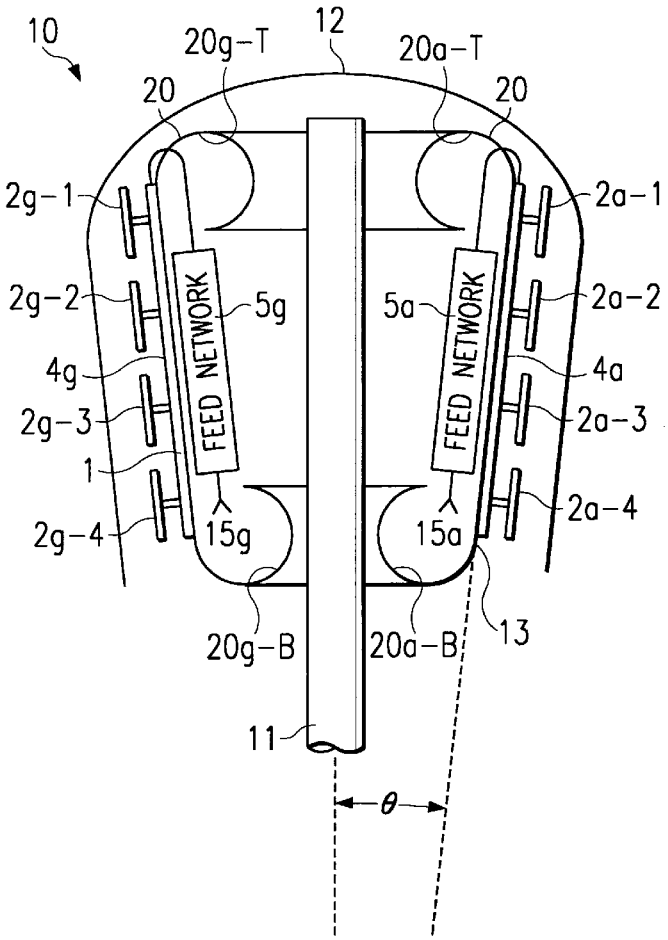
FIG. 1 is an axial cross-sectional view of the preferred embodiment of the inventive antenna.
Figure 2:
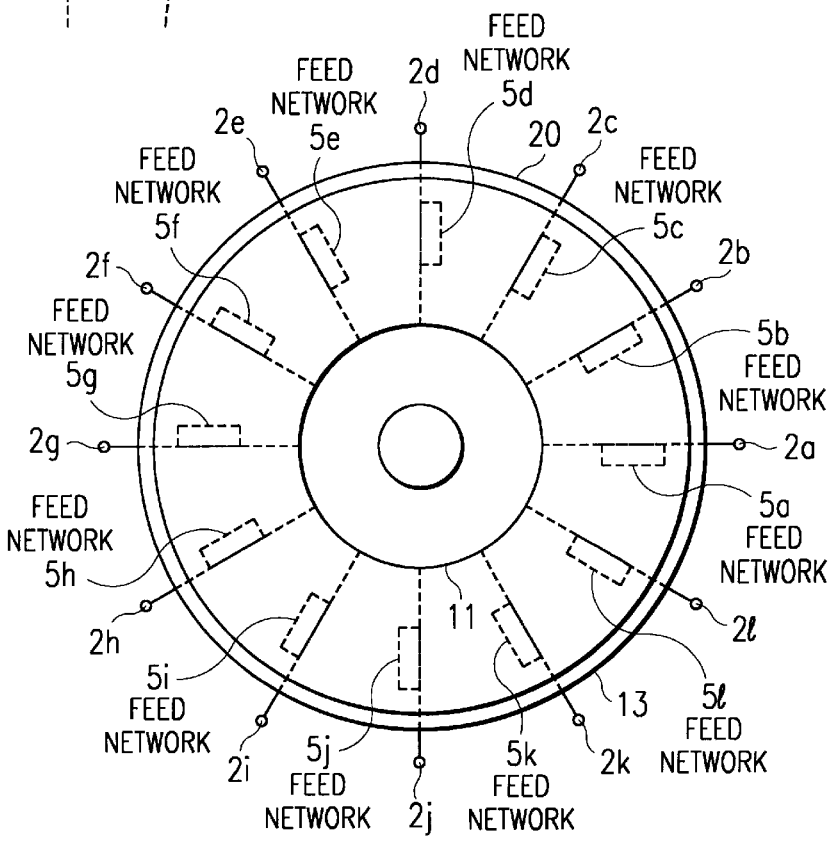
FIG. 2 is a top cross-sectional view of the antenna system shown in FIG. 1.
Figure 4:
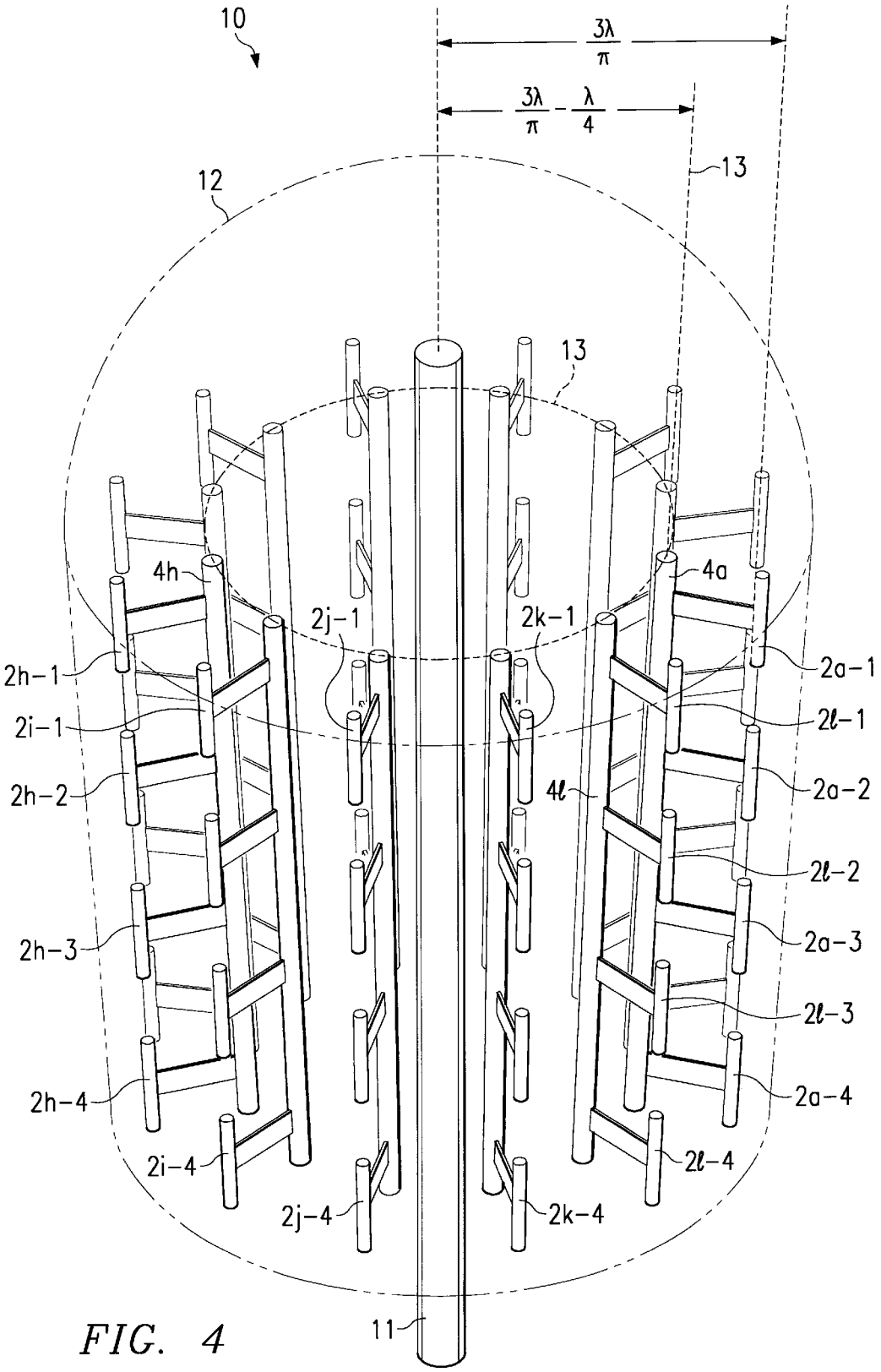
FIG. 4 is a full elevational view of the antenna system shown in FIG. 1.

As shown in FIG. 1, a preferred embodiment of the inventive antenna system 10 is shown having a conical shaped ground surface 13 held by mast 11. Ground surface 13 acts as a circumferential support for column radiators 2*a*–2*l* which are arranged around the peripheral of surface 13, as shown in FIG. 2. FIG. 4 shows a perspective view of antenna system 10. In the example shown, there are twelve vertical column radiators (2*a*–2*l*), each having 4 dipoles in this case, such as dipoles 2*a*–1, 2*a*–2, 2*a*–3 and 2*a*–4 for column 2*a* (FIG. 1). The column radiators are joined together by mounting them on a common feed system such as feed system 4*a* for radiator set 2*a* and feed system 4*b* for radiator 2*b* which in turn is connected by a coaxial connector (not shown) which feeds through the wall of conical ground surface 13 to a feed network associated with each column, such as feed networks 5*a*–5*l*. Of course, as discussed in detail below, the feed networks of each radiator column may be interconnected with the feed networks of other radiator columns, such as to provide beam forming, if desired.

Ground surface 13 is shown as a frustum of a right circular cone having angle θ with mast 11. This angle θ controls the area of coverage and allows for reuse of the frequencies. Angle θ could be variable, for example by tilting mast 11, from time to time, to allow for changing conditions.

$$\theta=\theta_M+\theta_E$$

The mechanical $\theta_M$ is established by the physical structure of the right circular cone. This $\theta_M$ can be supplemented or replaced by a $\theta_E$ which is an electrical down-tilt created by the relative phase relationship among the dipoles making up the vertical column.

A cylinder can be used to achieve down-tilt if the radiator columns are fed in such a way that ones of the individual radiating elements making up the column radiator have the appropriate inter-element phase relationship that produces the desired amount of down-tilting. In this case;

$$\theta=\theta_E,\theta_M=0$$

Of course this would, in theory, introduce a small amount of "scan-loss" so the physical method might be more desirable in some applications since it would project the greater amount of aperture area.

Figure 11A:
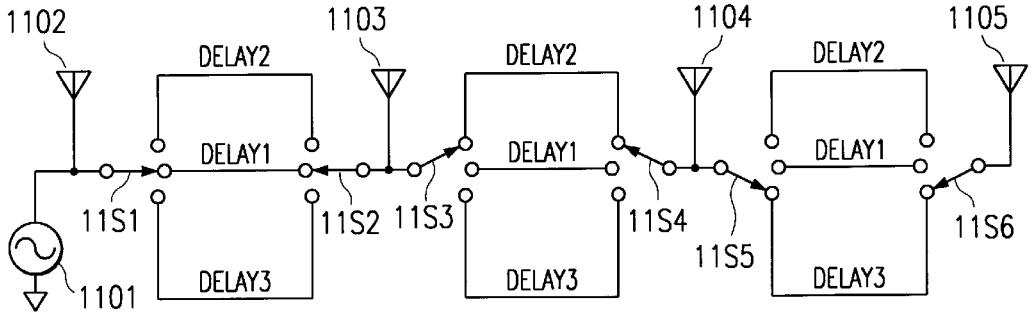
FIGS. 11*a* and 11*b* show a circuit for achieving a variable electrically created phase $\theta_E$.
Figure 11B:
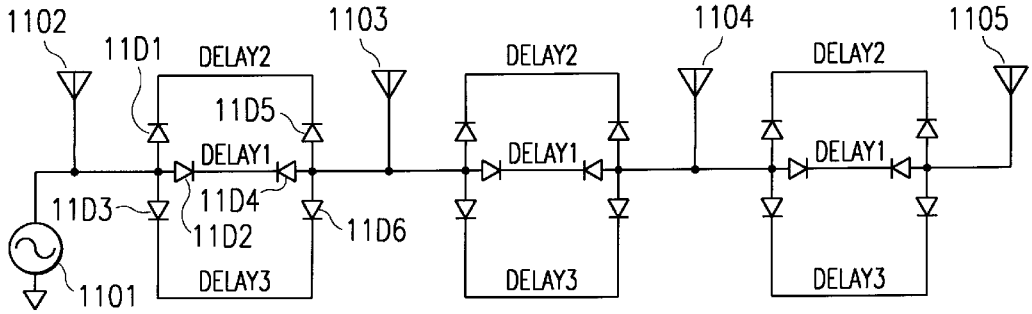

As shown in FIGS. 11*a* and 11*b*, different lengths of connecting transmission line can be "switched in" or "switched out" between the radiating elements making up the column. The different delays (different lengths of line), represent stepped changes in phase shift, since a λ length of line represents a 2π or 360° phase delay (shift). So, by switching in the appropriate lengths via switches 1151–1156, a relative phase shift is created between the radiating elements. This is depicted in FIG. 11*a*, where either delay 1, delay 2, or delay 3 is in the signal path. Where Delay 1<Delay 2 and Delay 2 is <Delay 3. This creates a constant relative phase shift between the energy arriving at the individual radiating elements. This condition makes the combined beam from this column of elements scan away to the right from the normal and parallel to the column axis.

In FIG. 11*b*, the switches have been replaced with diodes (PIN diodes for example), such as diodes 1101–1106 to effect the function of the mechanical switches as depicted in FIG. 11*a*.

Figure 16:
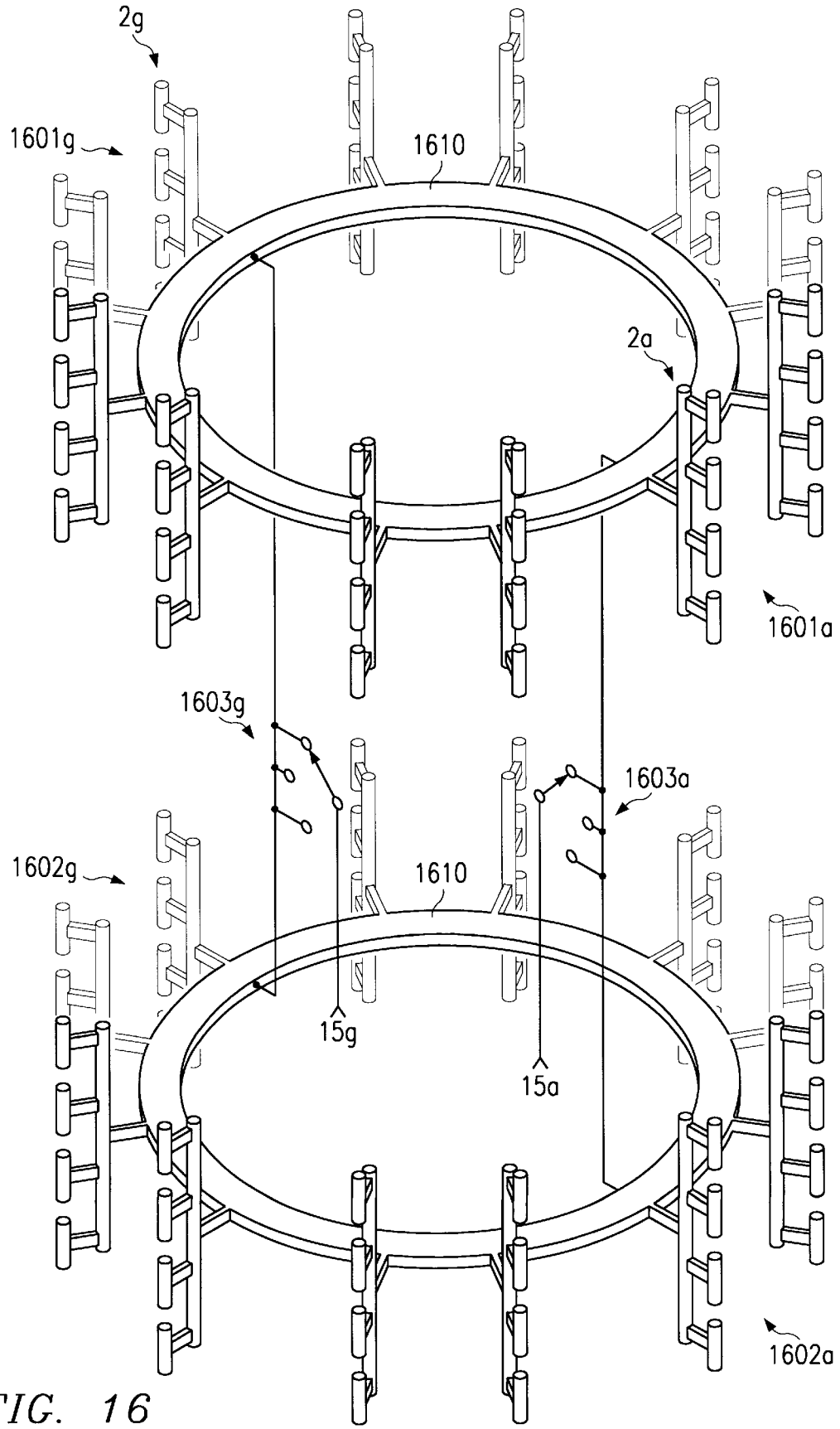
FIG. 16 shows an arrangement for achieving a variable electrically created down-tilt.

In FIG. 16, an alternative embodiment of a signal feed system producing electrical down tilt is illustrated. Here antenna elements of the antenna columns are divided into at least two subsections, for example subsections 1601*a* and 1602*a* of column 2*a* and subsections 1601*g* and 1602*g* of column 2*g*, each having four antenna elements associated therewith, wherein there is a phase differential between the signals provided to each subsection. Of course, more subsections can be used, each having a phase differential as compared to the other subsections, if desired. It shall be appreciated that, as the number of subsections increases, the steered beam quality increases in terms of grating lobe structures and side lobe levels. This effect has a rough analogy to the improvement of a digital representation of a time domain signal as the number of digital samples increased, although this case is in the spatial rather than time domain.

It shall be appreciated that a predetermined amount of phase difference may be included between the elements of each column subsection to improve beam quality when steered down. For example, a phase difference between the individual elements of each column subsection may be selected to optimize the beam at a predetermined down tilt angle. Introduction of a phase difference between the various elements of a column is discussed in more detail below with respect to FIG. 28.

The limit of the number of such subsections is dependent on the individual number of elements making up the antenna column, i.e., each individual antenna element may comprise a subsection according to the present invention. However, a minimum of two such subsections are required to affect any electrical down-tilt.

Figure 17:
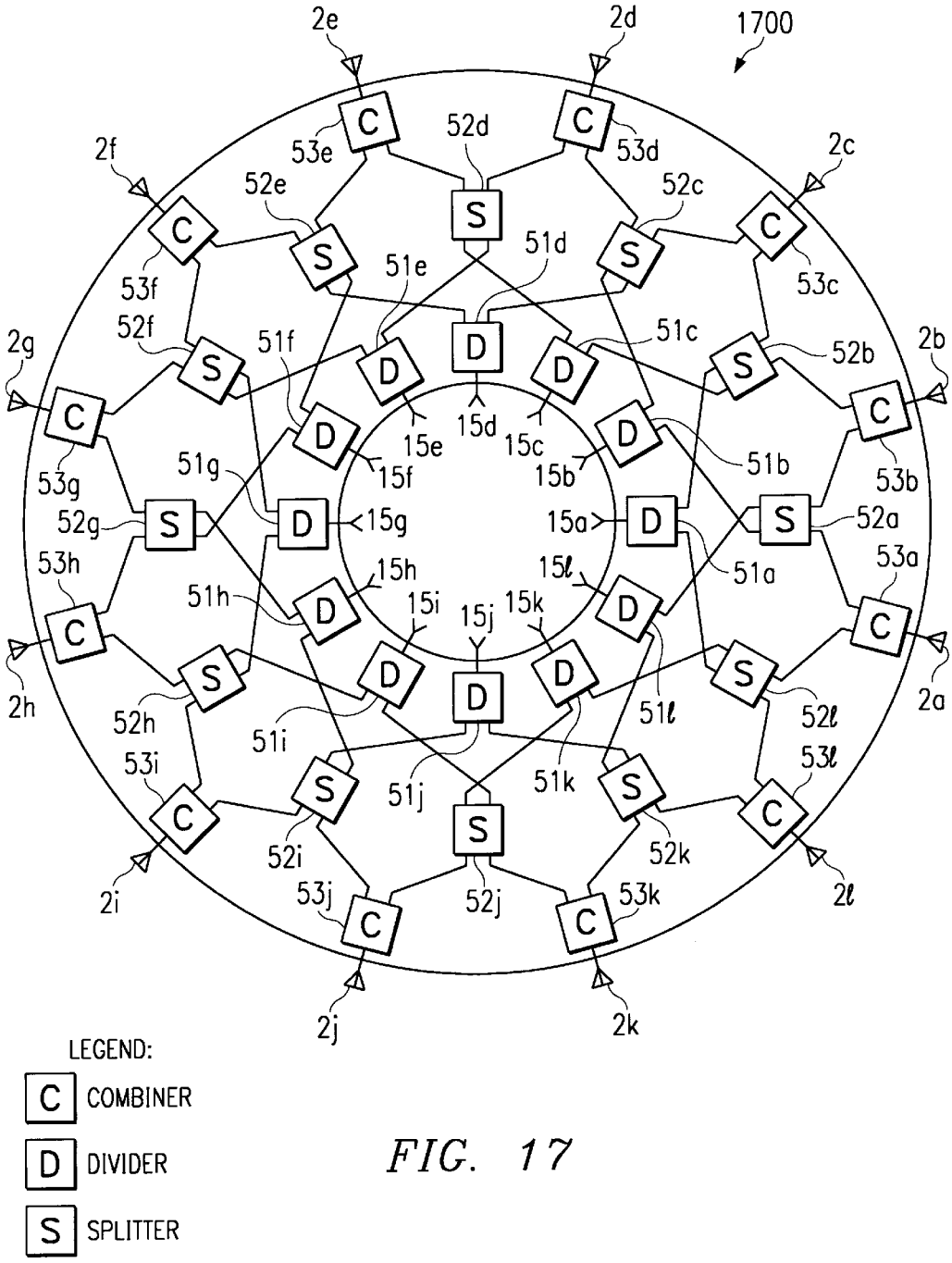
FIG. 17 shows the non-interleaved feed control network of FIG. 5 as a planar circuit feed ring.
Figure 18:
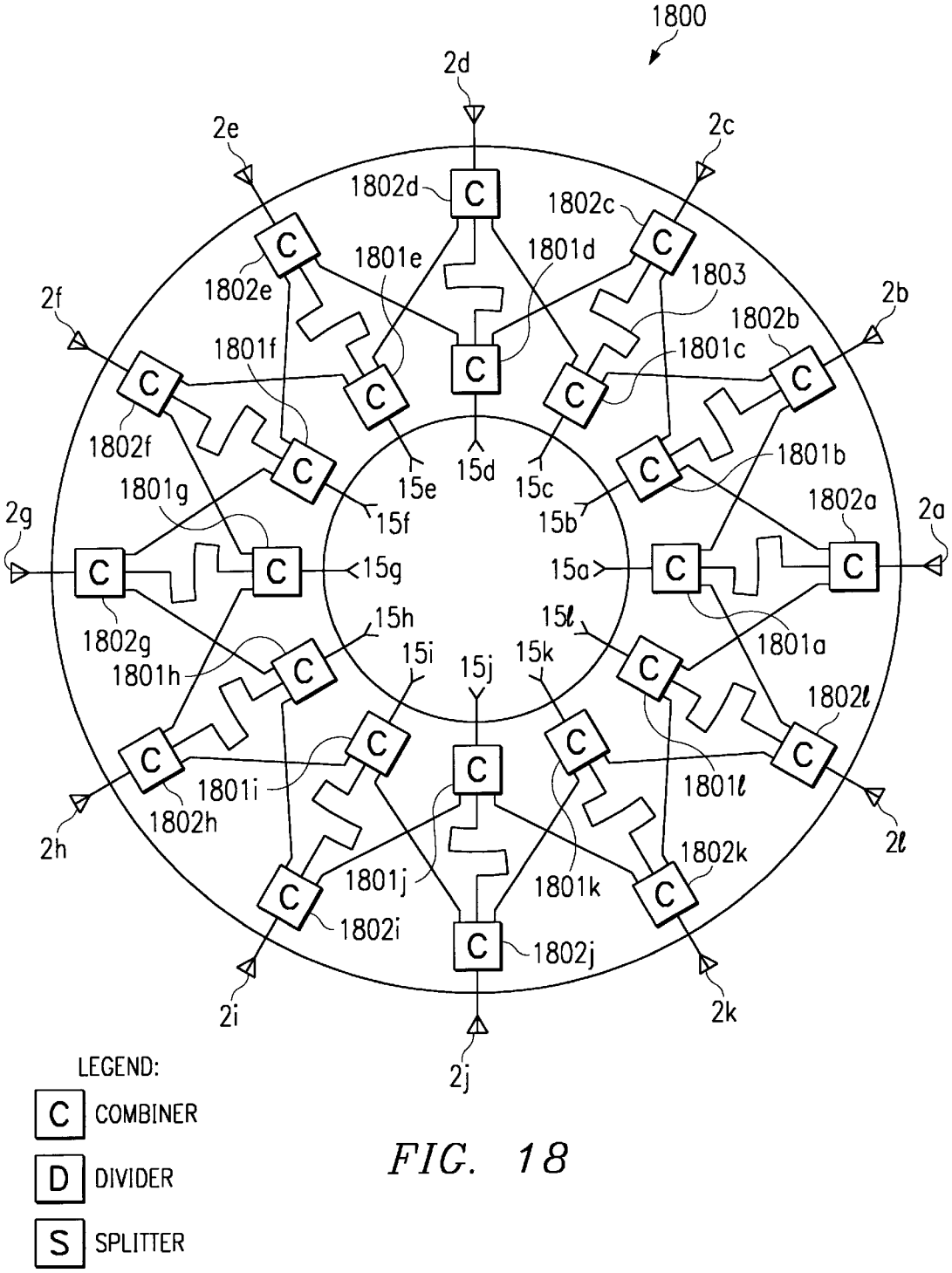
FIG. 18 shows an alternative non-interleaved feed control network as a planar circuit feed ring.
Figure 19:
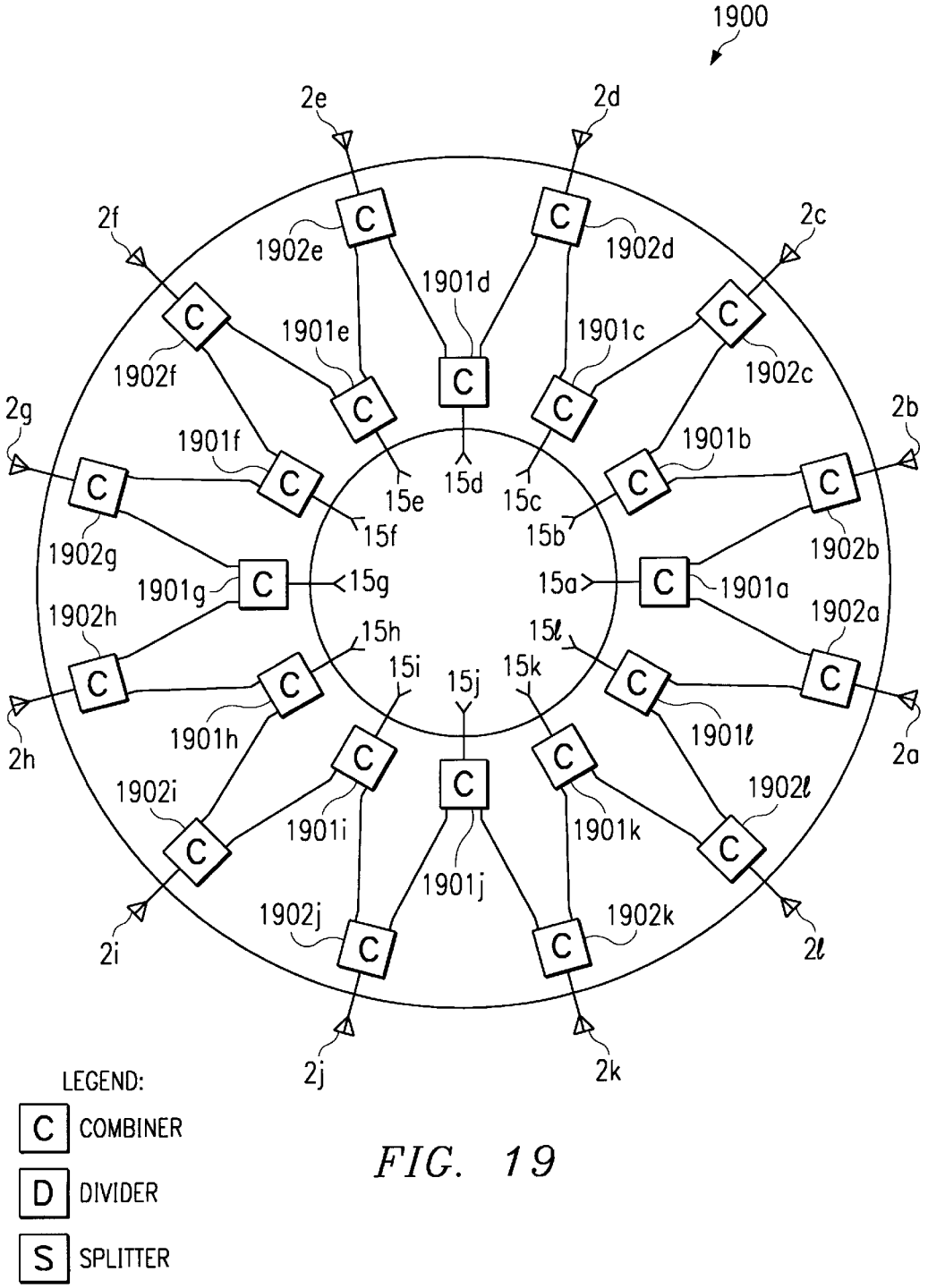
FIG. 19 shows another alternative non-interleaved feed control network as a planar circuit feed ring.

FIG. 16 illustrates feed rings 1610 in the signal path to each subsection. These feed rings, as are discussed in detail below with respect to FIGS. 17 through 19, provide signal division and combining to result in a select number of radiator columns being excited by an input signal. It shall be appreciated that, although only two radiation column inputs are illustrated, the rings may in fact feed any number of radiation columns each. The number of such radiator columns excited by an input signal defines the azimuthal beam width according to the present invention. However, it shall be appreciated that the use of such feed rings are not necessary to achieve the elevational beam steering, or down tilt, discussed herein. It shall be appreciated, however, that the illustrated configuration of multiple feed rings, i.e., feed networks providing an input signal to a select number of collocated radiator columns, illustrates how these feed rings can be stacked to affect elevation control of a beam having a predetermined azimuthal beam width formed from excitation of multiple radiator columns.

To provide the desired electrical down-tilt according to this embodiment, the subsections of a column are excited with a predetermined phase differential. The magnitude of this phase differential determines the amount of electrical down-tilt experienced. A phase difference in the signal provided to each subsection of a column may be introduced by any delay means deemed advantageous. For example, a surface acoustic wave (SAW) device may be placed in the signal path of subsection 1602*a* to introduce a signal delay and thus retard the arrival of energy at that subsection in comparison to subsection 1601*a*, therefore causing the combined radiation of the column to tilt downward. Alternatively, differing lengths of coax cable feeding the radiator column subsections may be used to introduce the desired phase differential.

In a preferred embodiment, coaxial switches, such as switches 1603*a* and 1603*g*, are adapted to select a "tap" position along a common feed line that connects the radiator column subsections to a common signal. These tap locations are disposed at predetermined positions along the common feed line to provide selectable differential phase shifts between the subsections energized by the input signal. For example, a tap location may be selected at a point in the common feed line being equidistant from each subsection. The input of a signal at this tap position, as selected by the switch associated with the radiator column, would provide an in phase signal to each subsection and thus result in a beam orthogonal to the excited column, i.e., no down-tilt.

However, in the case where it is desired to have the antenna beam "look down" (down-tilt), the upper subsection is advanced in phase through the use of a tap location selected at a point in the common feed line providing a shorter signal path to subsection 1601*a* than subsection 1602*a*. When the radiation from the upper subsection is combined with the phase delayed energy of the lower portion of the column, subsection 1602*a*, the entire beam is steered down. It shall be appreciated that the greater this phase differential, the greater the down-tilt. Therefore, multiple angles of down-tilt are accomplished by having the appropriate number of tap locations.

In a preferred embodiment, electrical down-tilt is accomplished through the introduction of phase differences between the various elements of the radiator columns in the signal path between the feed ring and the antenna elements. It shall be appreciated that this preferred embodiment may utilize a single feed ring of the present invention while still providing electrical down-tilt.

Figure 25:
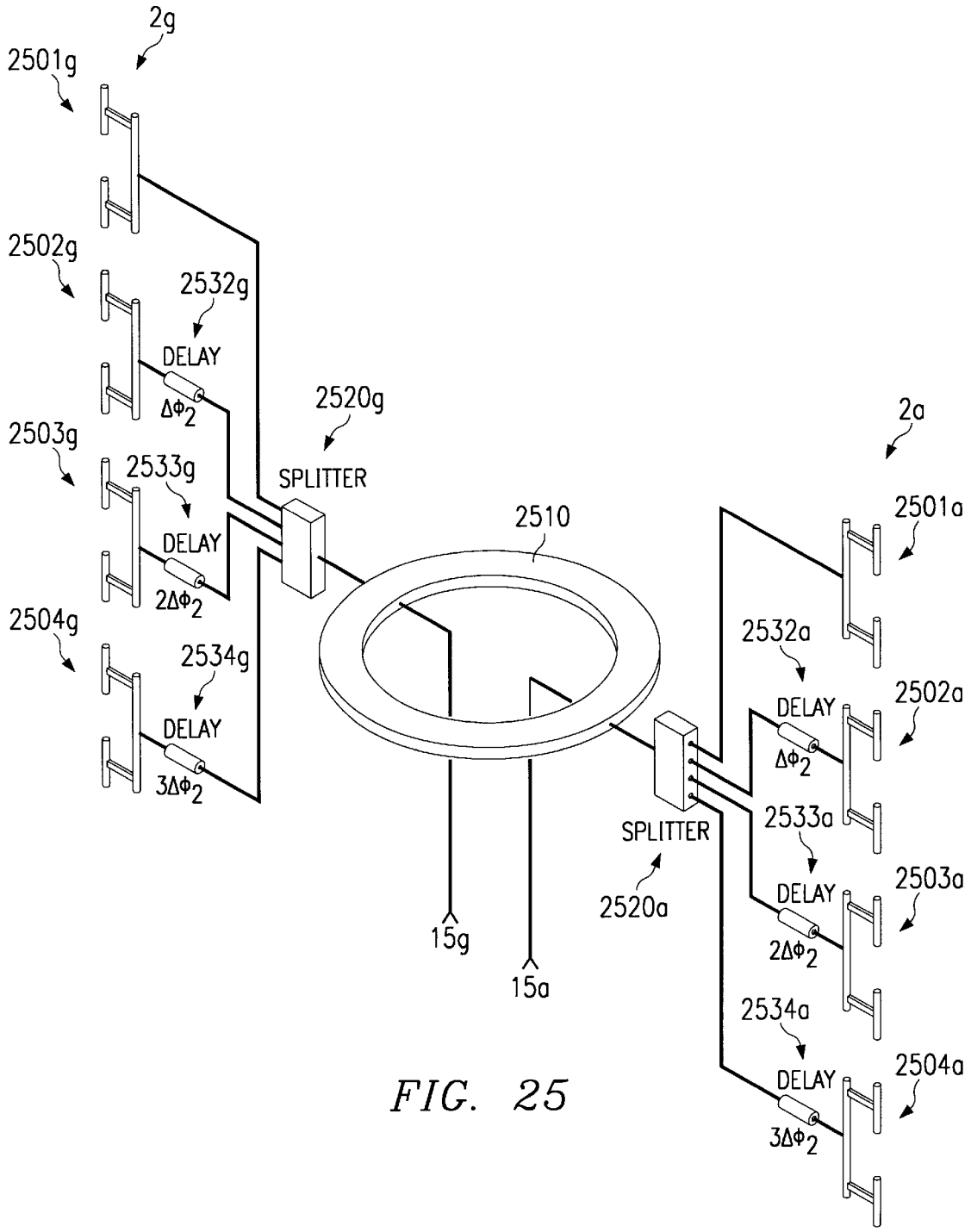
FIG. 25 shows a preferred embodiment for achieving electrically created down-tilt.

FIG. 25 shows the introduction of phase difference between various elements of the radiator columns using a single feed ring 2510. It shall be appreciated that, although only two radiation column inputs are illustrated, the feed ring may in fact feed any number of radiation columns.

As in the above described embodiment, electrical down-tilt is provided by exciting the subsections of a column with a phase differential. The magnitude of the phase differential determines the amount of electrical down-tilt.

Although columns having four subsections (subsections 2501*a*–2504*a* and 2501*g*–2504*g*) are shown, any number of subsections may be used. However, it shall be appreciated that at least two subsections must be used in order to introduce a phase difference to provide electrical down tilt. Additionally, as discussed above, the more radiator column subsections providing phase shifted signals, the more the steered beam quality may be improved.

The signals to be phase shifted and utilized for electrical down-tilt from a single feed ring are provided by splitting the signal associated with the radiator column into signal components associated with each column subsection. In the preferred embodiment, this is accomplished by splitters such as splitters 2520*a* and 2520*g*.

The split signals from splitters 2520*a* and 2520*g* are provided to the antenna column subsections 2501*a*–2504*a* and 2501*g*–2504*g* respectively. However, in order to introduce a phase difference to effect down-tilt, the signal paths of column subsections 2502*a*–2504*a* and 2502*g*–2504*g* include delays 2532*a*–2534*a* and 2532*g*–2534*g* respectively. Preferably, these delays are adaptable to provide a proper amount of delay with respect to a next antenna subcolumn so as to produce a desired steered beam.

For example, delay 2532*a* of subcolumn 2502*g* may be determined to be $\phi_2$ in order to provide a radiated signal to sum with that of subcolumn 2501*a*, resulting in a downward tilted summed signal. Assuming that each antenna column subsection of column 2*a* are equally spaced, the delay of delay 2533*a* would preferably be $2\phi_2$ and that of delay 2534*a* would $3\phi_2$.

Delays 2532*a*–2534*a* and 2532*g*–2534*g*, may introduce signal phase delay by any number of means. For example, each of delays 2532*a*–2534*a* may be a predetermined length of cable. Where couplers are provided, different cable sets may be installed to provide different amounts of down-tilt. Similarly, delays 2532*a*–2534*a* may be SAW devices as described below.

Figure 26:
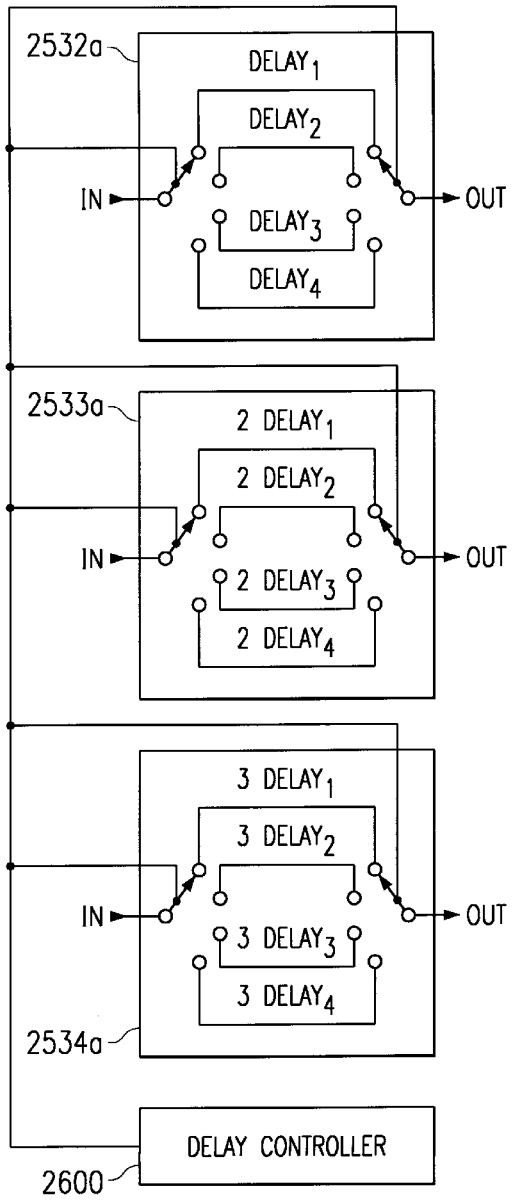
FIG. 26 shows an embodiment of delay devices utilized for providing electrical down-tilt in the embodiment of FIG. 25.

Moreover, the delays of the present invention may be adjustable delay devices to introduce differing delays (i.e., $\Delta\phi_2$, $2\Delta\phi_2$, and $3\Delta\phi_2$.) One embodiment of adjustable delay devices is shown in FIG. 26. Here, as in FIG. 11*a*, discussed previously, different lengths of cable are switched into the signal paths to provide adjustable delays. Of course, the switching of these delays may be through the use of PIN diodes, such as shown in FIG. 11*b*, if desired. It shall be appreciated that the delays of each delay 2532*a*–2534*a* are incrementally increased as discussed above. Of course, any delays determined to be beneficial may be utilized, if desired.

Shown in FIG. 26 is delay controller 2600 coupled to each of the delay devices. Delay controller 2600 provides automated control of selection of the various delays to select a particular down-tilt. Selection of the delays may be a function of communication information, such as signal to noise or carrier to noise information, or selection may be a function of binformation provided by a communication network controller controlling a network of such antenna systems. Of course, selection of the various delays of delays 2532*a*–2534*a* may be by manual means, such as by physically rotating a switch associated with each delay device, if desired.

Figure 27:
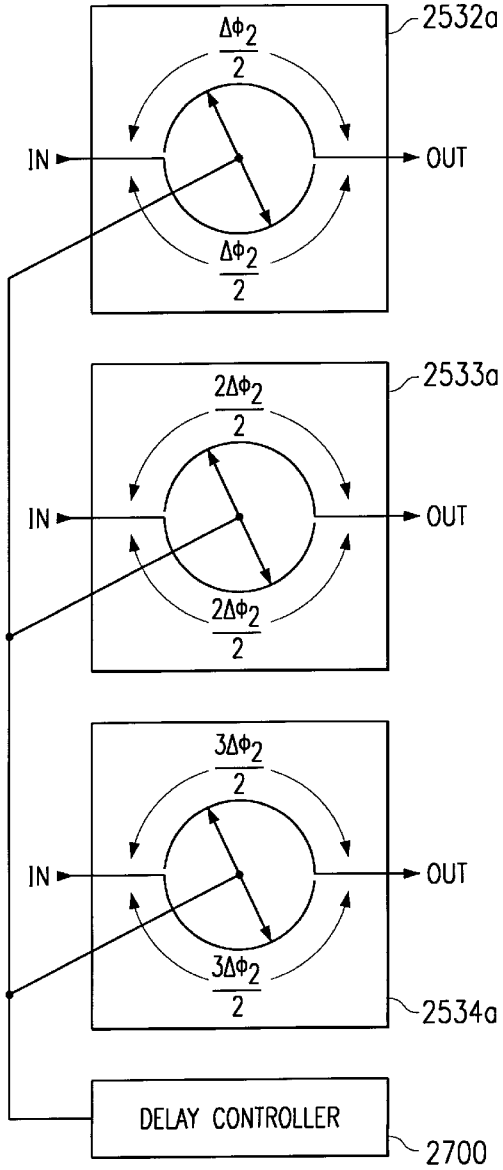
FIG. 27 shows an alternative embodiment of delay devices utilized for providing electrical down-tilt in the embodiment of FIG. 25.

An alternative embodiment of the variable delay devices are shown in FIG. 27. Here a delay is selected by rotating the tap of each delay device to utilize a different length of signal path. It shall be appreciated that the phase shift introduced by each delay device 2532*a*–2534*a* of this embodiment are incrementally larger between the various delay devices as discussed above with respect to FIGS. 25 and 26.

For example, the phase shift introduced by delay 2532*a* is, depending on the adjustment of the tap, some function of $$\Delta\phi_2 \left(\text{i.e., } f\left(\frac{\Delta\phi_2}{2} + \frac{\Delta\phi_2}{2}\right)\right).$$

Likewise, the phase shift of delay 2533*a* is some function of $$2\Delta\phi_2\left(\text{i.e., } f\left(\frac{2\Delta\phi_2}{2} + \frac{2\Delta\phi_2}{2}\right)\right).$$

Of course, as discussed above, any relationship of delays between the delay devices may be used that is determined to be advantageous.

Shown in FIG. 27 is delay controller 2700. This may be an automated delay controller such as a servo-motor coupled to a common shaft gang or individual servo-motors coupled to each delay device. Automated adjustment may be based on communication parameters, communication network conditions, or the like. Controller 2700 may also be a manual adjustment means such as a mechanical dial coupled to a common shaft gang.

Figure 28:
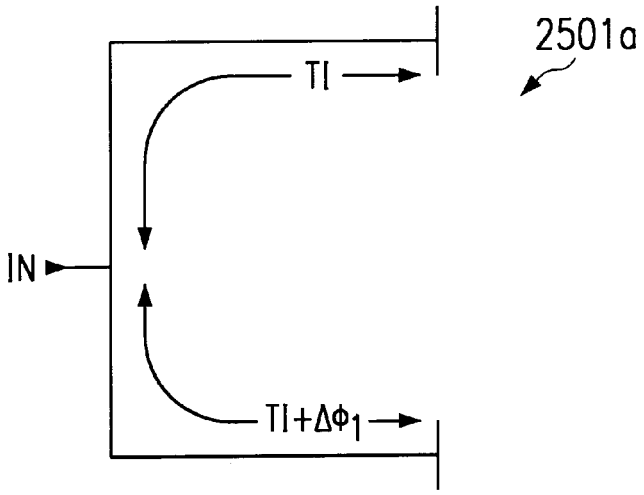
FIG. 28 shows the introduction of a phase difference between the antenna elements of a column subsection of FIG. 25.

In addition to the down-tilt associated with the phase difference introduced by delays 2532*a*–2534*a*, there may also be down-tilt associated with each column subsection. Referring to FIG. 28, a phase difference between the two elements of column subsection 2501*a* is shown as signal paths T1 and T1+$\Delta\phi_1$. This phase difference may be utilized to improve the composite beam quality when the signal of the antenna column is steered down.

For example, the delay associated with $\Delta\phi_1$, may be selected to optimize the beam at a predetermined down-tilt angle. Where a particular down-tilt angle is expected to predominate, $\Delta\phi_1$, may be selected to cause the summed signal of the elements of column subsection 2501*a* to result in that particular down-tilt. Of course, this intra-column subsection down-tilt may introduce some undesirable characteristics when the composite beam of the antenna column subsections are summed. These undesirable characteristics would increase as the beam is steered further away from the down-tilt angle selected for the intra-antenna column subsection delay. Therefore, alternatively, $\Delta\phi_1$, may be selected to commensurate with some angle between the various down-tilt angles expected to be used. This selection of $\Delta\phi$, would minimize the effect of the undesirable characteristics at each of the down-tilt angles.

Of course, the phase difference $\Delta\phi_1$ may be introduced by variable delay means, such as described above, if desired. However, an advantage of the use of antenna column subsections in the electrical down-tilt, rather than individual elements, is to reduce the various components necessary to affect the electrical down-tilt. Adding variable delay means between the various antenna elements of the column subsections would increase the number of components used in achieving electrical down-tilt. However, it shall be appreciated that less expensive variable means, such as the aforementioned mechanical means, may be utilized at the antenna column subsections to more economically provide such electrical down-tilt adjustable to each antenna element.

It shall be appreciated that the antenna column subsections may include any number of antenna elements determined advantageous. For example, the column subsections of this embodiment may include four elements as shown in FIG. 16. Similarly, each column subsection may include a single element. This single element embodiment will typically provide the best composite beam attributes when electrically steered, because each element is excited with the proper phase delay for the particular down-tilt desired, but will typically require the maximum number of delay components.

Figure 5:
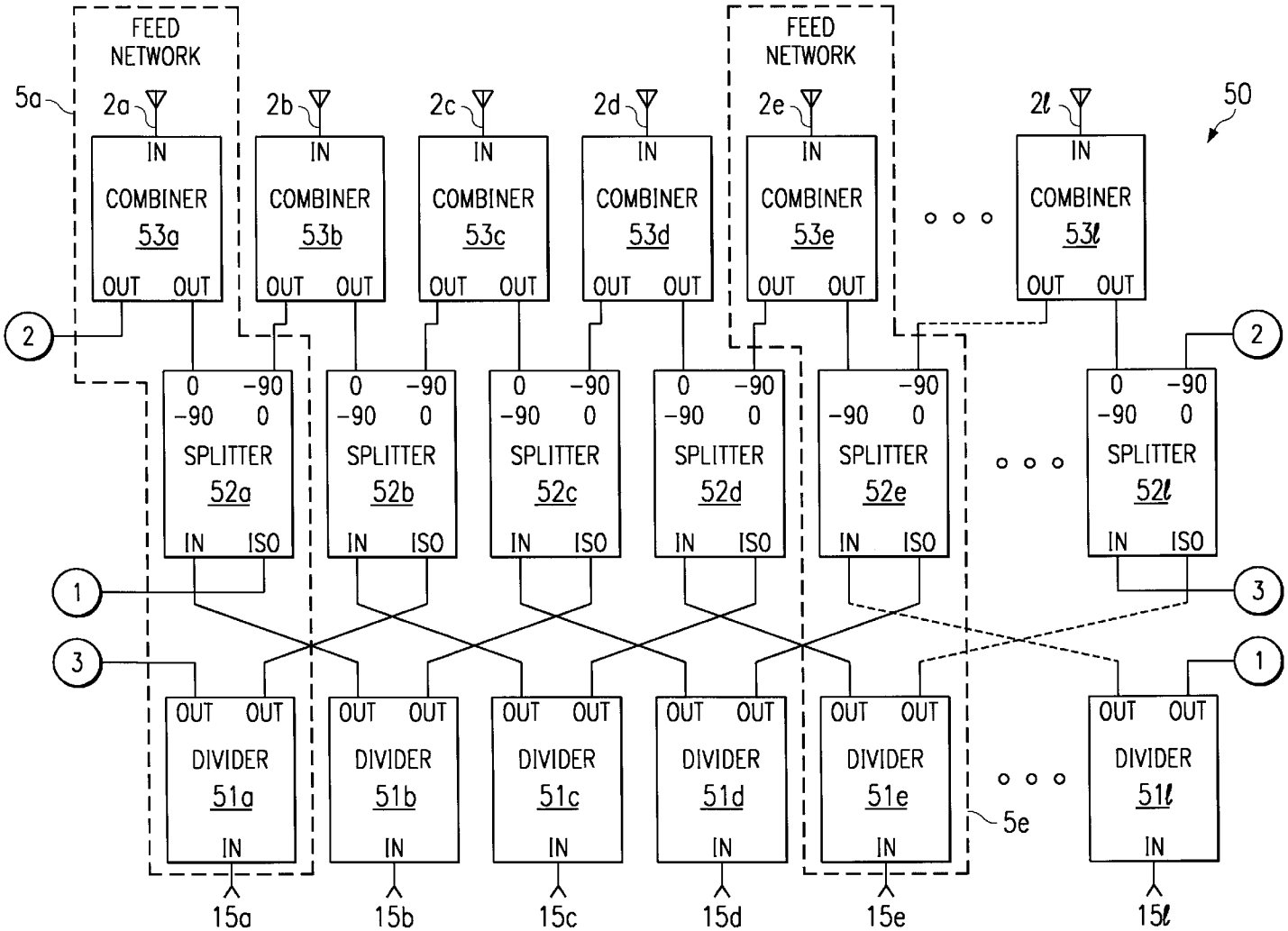
FIG. 5 shows a twelve-column (a–l) non-interleaved feed system for the antenna system shown in FIG. 1.

FIG. 5 shows a control network for a non-interleaved twelve radiating column system formed to include a four-column excitation. Here, feed networks 5*a*–5*l* of radiator columns 2*a*–2*l* are interconnected to form radiator column feed control network 50 controlling beam forming by exciting co-located columns.

In the case of a transmitter (TX), the energy enters at one or more of the coax connectors or inputs 15*a*–15*l*. For each connector, such as connector 15*c*, the energy is equally divided by divider 51*c*. The energy is split evenly and arrives at splitters 52*b* and 52*d*. That energy again is divided by splitter 52*b* coming out as 0° and −90°, and by splitter 52*d*, coming out as −90° and 0°. This energy is then routed to combiners 53*b*, 53*c*, 53*d*, and 53*e*, which illuminates or excites antenna columns 2*b*, 2*c*, 2*d* and 2*e*, respectively. The object is that energy enters connector 15*c* and is supplied to four antenna columns such that reading across from left to right the phase of the energy is at 0° at antenna 2*b*, −90° at antenna 2*c*, −90° at antenna 2*d*, and 0° at antenna 2*e*. This topology creates a beam defined by four antenna columns which are illuminated in this manner.

Elements in FIG. 5, labeled 51*a* through 51*l*, are called "Wilkinson combiners." Each of the elements 51*a* through 51*l* have a single input, labeled as 15*a* through 15*l* respectively, which is divided into two outputs. Energy coming out of the elements is split but in phase. That is important.

Elements 53*a* through 53*l* are also "Wilkinson combiners." This is an in-phase power splitter. Elements 52*a* through 52*l* have two inputs, associated with elements 51*a* through 51*l*, and two outputs, associated with elements 53*a* through 53*l*. One input is called "IN" and the adjacent one is called "ISO", or isolation. On the output side there is a terminal that is marked zero and one marked −90°. When energy comes to the input port, if you go straight up, you go to zero, if you go across to the other port, it is −90°. If energy comes straight up from the isolation port, it is at zero (under the −90° mark) and if energy goes across, the device is at −90° (under the zero mark). This is called a hybrid. The difference between it and the Wilkinson element is the fact that it has two inputs and the outputs have a 90° relationship with each other. That is essential to the functioning of the system and the forming of the beam according to one topology of the feed control network.

Let's now look at the power flow through the feed system. When you connect a source to a Wilkinson, let's say we are looking at element 51*c*, with a 1-watt source. What will happen is that ½ watt will come out of each output port and in phase. Now with element 53, if we have two ½ watt sources going in, we will have 1-watt coming out. That is a straightforward relationship. This is called coherent combining. In other words, to hook up an energy source at the two outputs of element 53*c*, ½ watt on one side and ½ watt on the other side, they must be in phase and at the same frequency. Let's assume we hook up a 900 MHz ½ watt source on one out port of element 53*c*, as we would for cellular communications. On the other out port of element 53*c*, there is another independent 900 MHz ½ watt source, but also in phase (coherent) with the first 900 MHz source. Those two sources will combine and will come out a 900 MHz, 1-watt combined source.

Now assume we have two sources, one is at 900 MHz ½ watt and one is at 800 MHz ½ watt, each being connected to a respective out terminal of element 53*c*. What comes out to antenna 2*c* is not 1 watt. What happens is a 3 dB is lost by each source. This occurs because there is a resistor across the two output ports. When the element senses that there is non-coherent (different frequencies) combining, even though they are each at ½ watt, what comes out is a ¼ watt 800 MHz source, and a ¼ watt 900 MHz source. They are not combined at all. They are just separate entities coming out of the input port to the antenna. When the system has separate transmitters on 15*c* and 15*d*, one could be at 900 MHz and one at 800 MHz, left alone they would create two separate beams. These two beams share antenna 2*d* which is fine, but a 3 dB tax has been paid. The advantage of the non-interlaced column feed is the fact that the antenna structure is straightforward, there are not as many radiating antennas, but a power loss is experienced by this non-coherent combining.

Figure 12:
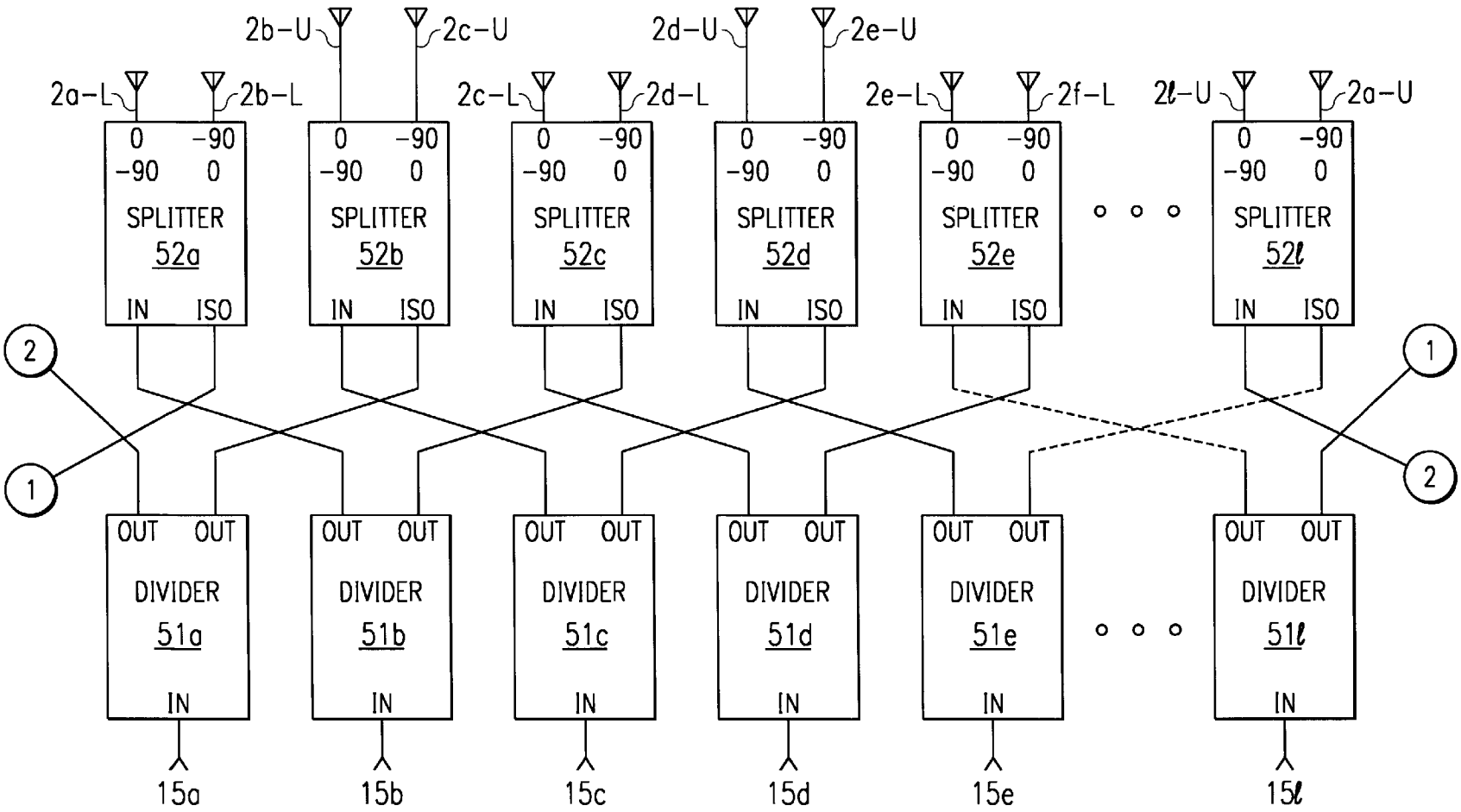
FIG. 12 shows a twelve-column (a–l) interleaved feed system for the antenna system shown in FIG. 13.
Figure 13:
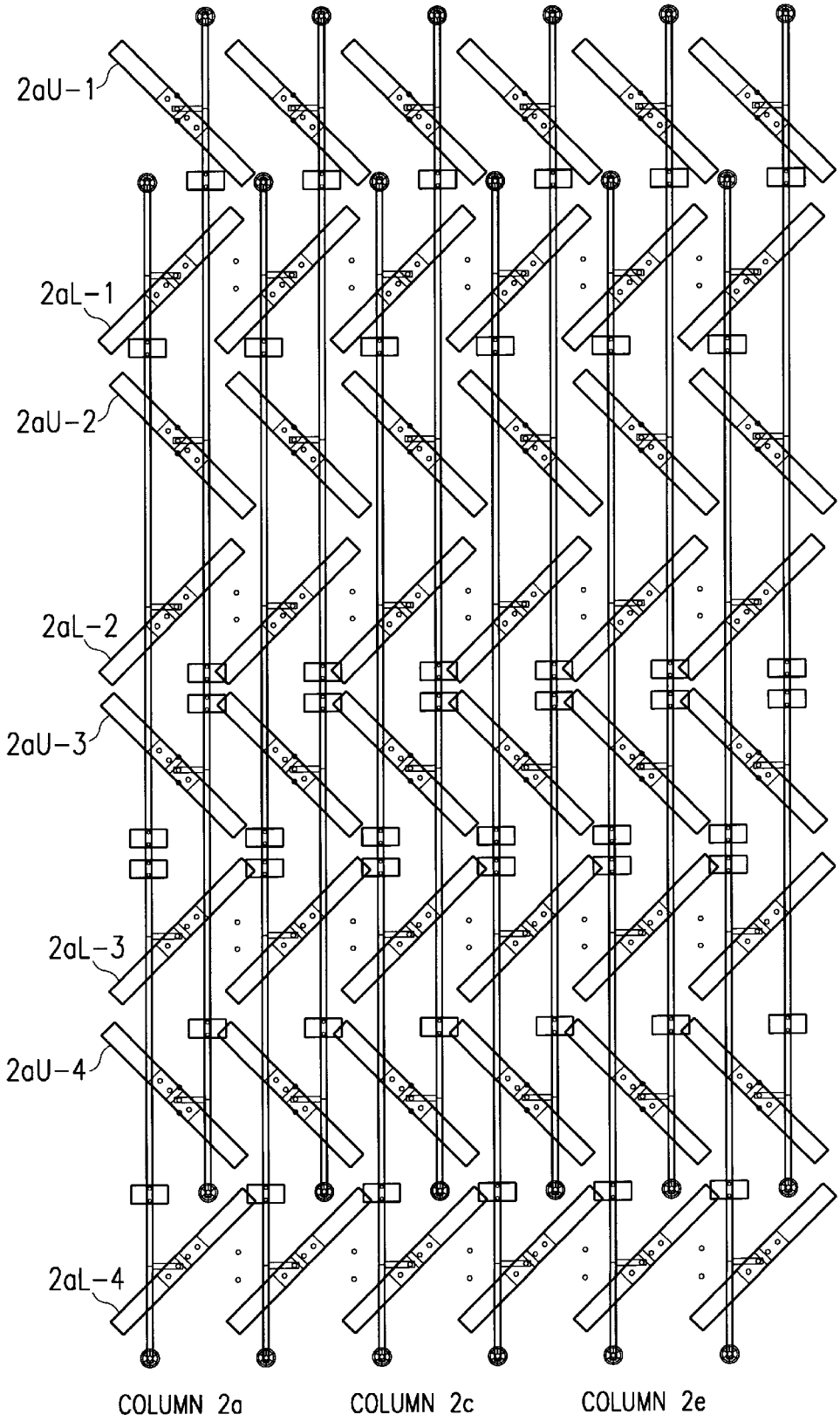
FIG. 13 shows the physical structure of an interleaved antenna system.

In order to avoid the non-coherent combining as discussed above, I have developed an alternate system that uses two antennas per column as shown in FIGS. 12 and 13. This is an alternative to FIG. 5 and uses an interleaved system. As can be seen, there are more antenna symbols such as 2*a*–U and 2*a*–L for each column. It shall be appreciated that illustration of these subcolumns being differing lengths is to show associated pairs of subcolumns which may be polarized differently to provide polar diversity.

Each column of this embodiment includes two subcolumns having four elements. Thus, as shown on FIG. 13 for column 2*a* we have 2*a*U–1, 2*a*L–1, 2*a*U–2, 2*a*L–2, 2*a*U–3, 2*a*L, 3, 2*a*U–4 and 2*a*L–4. Of course, more of less elements may be used, if desired.

Returning to FIG. 12, let us look at element 51*c* again which is a Wilkinson. Now we hook up a 1-watt transmitter to it and the power comes out, equally split, ½ watt on each output port, and both of those split signal paths arrive at elements 52*b* and 52*d* in phase. Now, instead of the power going back to a Wilkinson (as with the non-interleaving system of FIG. 5), the power goes directly to the respective antenna 2*b*–U, 2*c*–U, 2*d*–U, and 2*e*–U which are excited with the desired 0°, −90°, −90°, and 0° phase relationship respectively.

It shall be appreciated that a signal input into element 51*d* comes out, equally split with ½ power on each output port, arriving at elements 52*b* and 52*e* in phase. Now, the power goes directly to the respective antennas 2*c*–L, 2*d*–L, 2*e*–L, and 2*f*–L. It therefore shall be appreciated that signals provided to alternating input ports, i.e., 15*a*, 15*c* . . . 15*k* or 15*b*, 15*d*, 15*l*, will excite alternating subcolumns of the radiating columns.

It should be clear from the foregoing discussion that the feed networks of the present invention, such as that illustrated in FIG. 5 can be used in either direction and, in fact, the same circuit is used for the receive antennas of the system.

Figure 3:
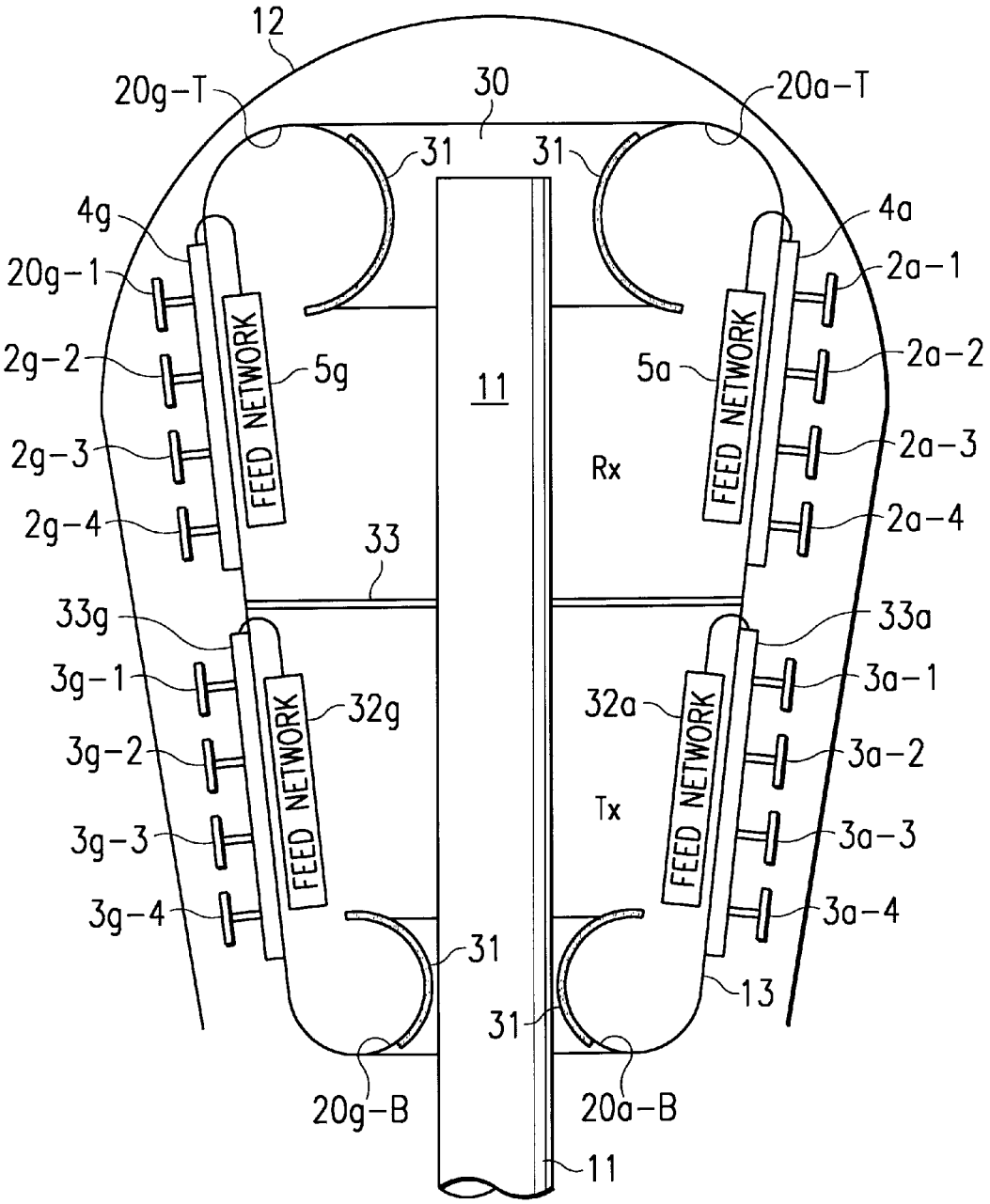
FIG. 3 is an axial cross-sectional view of the compartmentalized version of the inventive antenna, showing separate TX and RX sections.

FIG. 3 shows that the internal compartment 30 of the cylinder can include partition 33 to create a separate transmit and receive system. An example would be to have the upper portion of the system be receive only, while the lower portion would be transmit only. This would afford the elimination of costly and complicated duplexer systems that are used when receivers and transmitter systems share the same antenna system. Two such systems (cylinders in this case) could be separated in space to effect space-diversity, horizontally or vertically. The first side lobes and others can be reduced by the presence of the upper and lower elevation side lobe suppressor torus, as shown in FIG. 3 as elements 20*a*–T(TOP), 20*a*–B(BOT), 20*g*–T and 20*g*–B. The sheet current created as a by-product of the normal function of electromagnetic radiation, can have undesirable side effects, especially if this current sheet happens onto a surface discontinuity such as an edge. The discontinuity then will act as a launch mechanism and convert the sheet current back into propagating radiation. The edge, in the case of a cylinder, acts like two radiating hoop structures, (one on top and one at the bottom of the cylinder) that superimpose their respective radiation patterns onto the desired column radiator pattern. Thus, by having the sheet current follow the curve of the torus, ideally having a radius $>\lambda/4$ and when an absorbing material 31 is present to turn this current into heat, the side lobes in the elevation surface can be controlled. Four such suppressors could be used, one in each chamber, for an RX and TX antenna system, if desired.

In the example of FIG. 12, the columns are to be separated from each other by $$\leq \frac{4}{5}\lambda.$$

Since there are twelve such columns, the circumference of the column radiators is defined, for example use $$\frac{\lambda}{2}.$$

$$\text{Circumference} = 2*\pi*\text{radius} = 12*\left(\frac{1}{2}\right)*\lambda$$

$$\text{radius} = \frac{(3*\lambda)}{\pi}$$

Now, if we choose to normalize the value of λ to equal a value of one, we can use the following numerical values.

$$\frac{(3*\lambda)}{\pi} = 0.9549$$

The above value establishes how far the column radiators should be from the center of the cylinder in the X-Y surface. Since dipoles are being used in this example, and since we choose to have them at λ/4 above the ground surface, the radius of where the ground surface is in relation to the center of the system is established.

$$\frac{(3*\lambda)}{\pi} - \frac{\lambda}{4} = 0.7049 \text{ where } \lambda = 1$$

With the above parameters established we can proceed with the description of the antenna system.

Figure 14A:
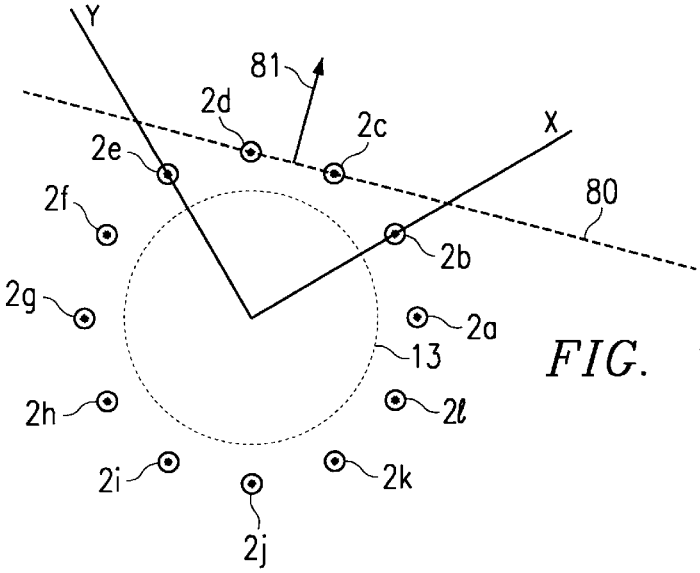
FIGS. 14*a*–14*c* are phase relationship diagrams.

The principle of this antenna system is to generate a wave front by the excitation of the appropriate radiator columns 2*a*–2*l* and by phase shifting (delaying) the "inner" column radiators. In this example, we will synthesize the creation of a planar wave front. Referring to FIG. 14*a*, radiator columns 2*c* and 2*d* are phase retarded by 90° with respect to columns 2*b* and 2*e*. The combined wave front 80 adds in the direction of arrow 81 to produce a planar wave front.

Figure 14B:
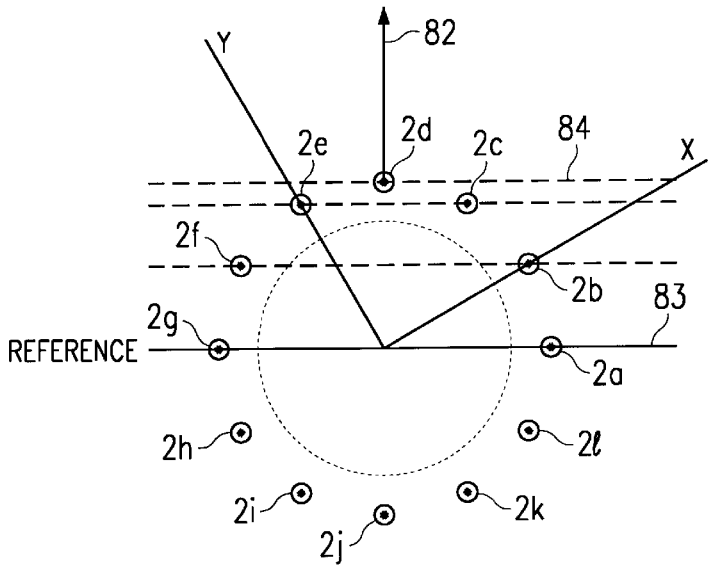
Figure 14C:
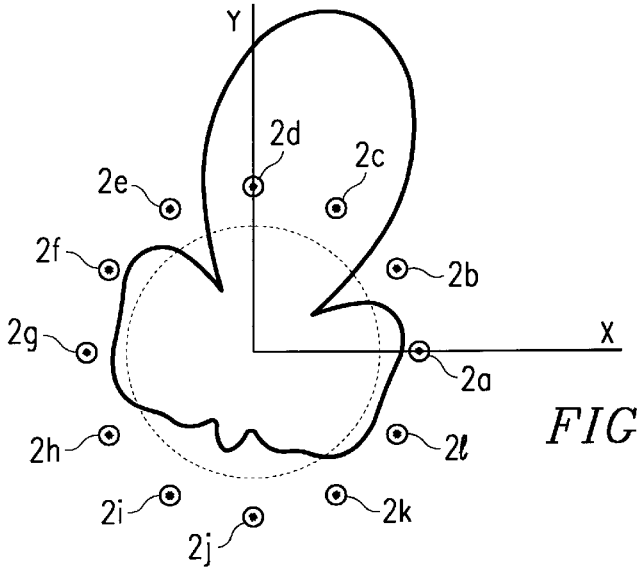

For more columns to be driven, the inner columns (those closest to the wave front) must be delayed in single or in pairs, to match the phase of the most outer column elements. Referring to FIG. 14*b*, we have seven radiator columns (2*a* through 2*g*) involved and the idea here is to synthesize a wave front in the direction of arrow 82. First we retard column 2*d* 's excitation by the angular displacement with respect to a line 83 drawn through points 2*g*–2*a* and its advance parallel line 84 through point 2*d*. Second, we retard columns 2*e* and 2*c* excitation by the angular displacement between line 83 and a parallel line drawn through points 2*c*–2*e*. Thirdly, we retard the excitation of columns 2*f* and 2*b* with respect to line 83. This allows the energy propagating away from line 83 in the direction of arrow 82 to "catch-up" with the energy going in the same direction from the other elements 2*b*–2*f*.

Figure 6A:
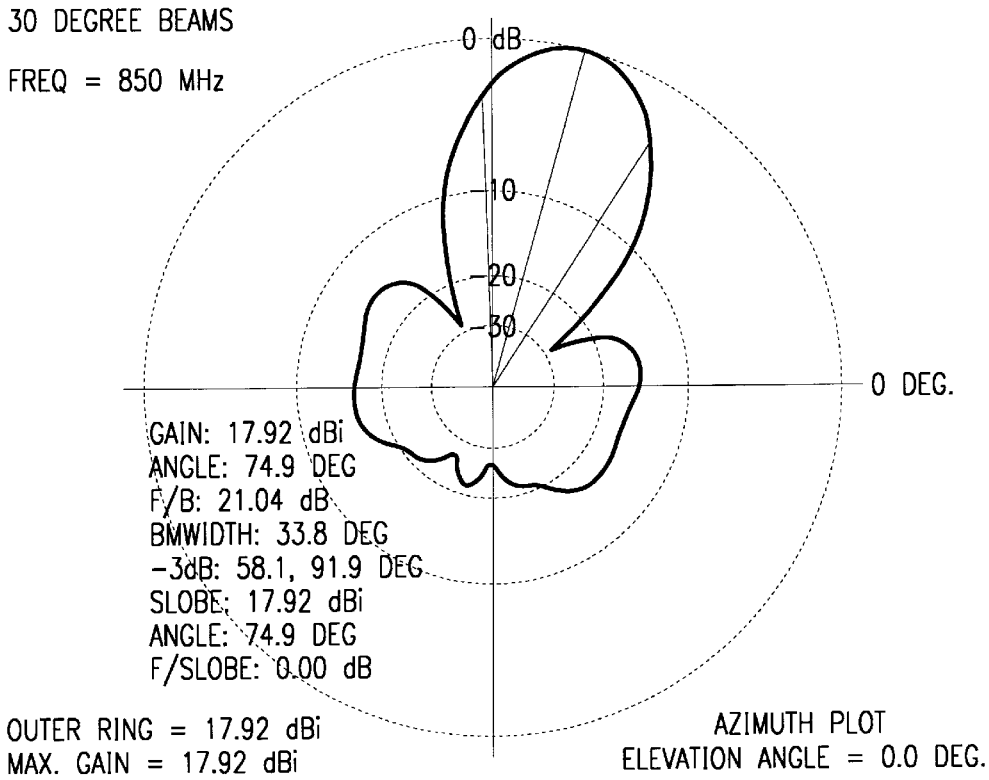
FIGS. 6*a*–6*c* are estimated azimuthal far-field radiation patterns using the method of moments with respect to the antenna shown in FIG. 1.
Figure 6B:
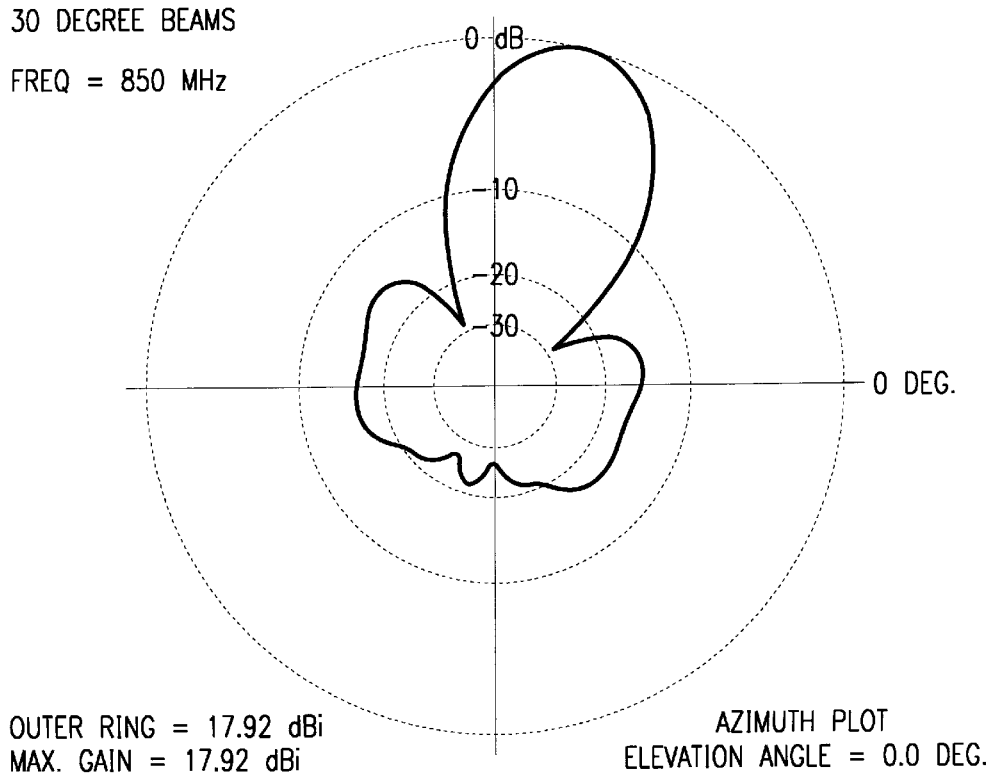

Thus far we have described how a wave front can be synthesized in the "first-degree", as shown in FIGS. 6*a* and 6*b*. A more sophisticated synthesis takes into account the effect of the divergence factors resulting from the outer column image sources and the presence of the curved conic surface effecting these image sources.

$$D = \text{divergence factor}$$

$$D = \frac{\text{reflected field curved surface}}{\text{reflected field flat surface}}$$

Figure 9A:
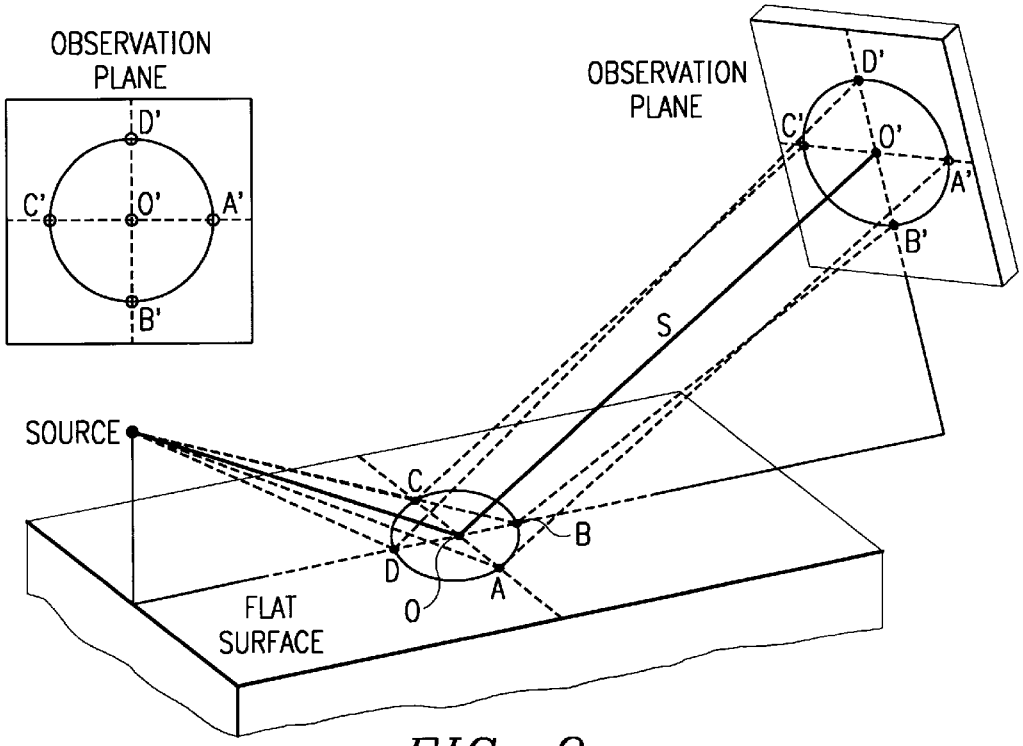
FIGS. 9*a* and 9*b* are diagrams illustrating reflections from a flat and a spherical surface, respectively.
Figure 9B:
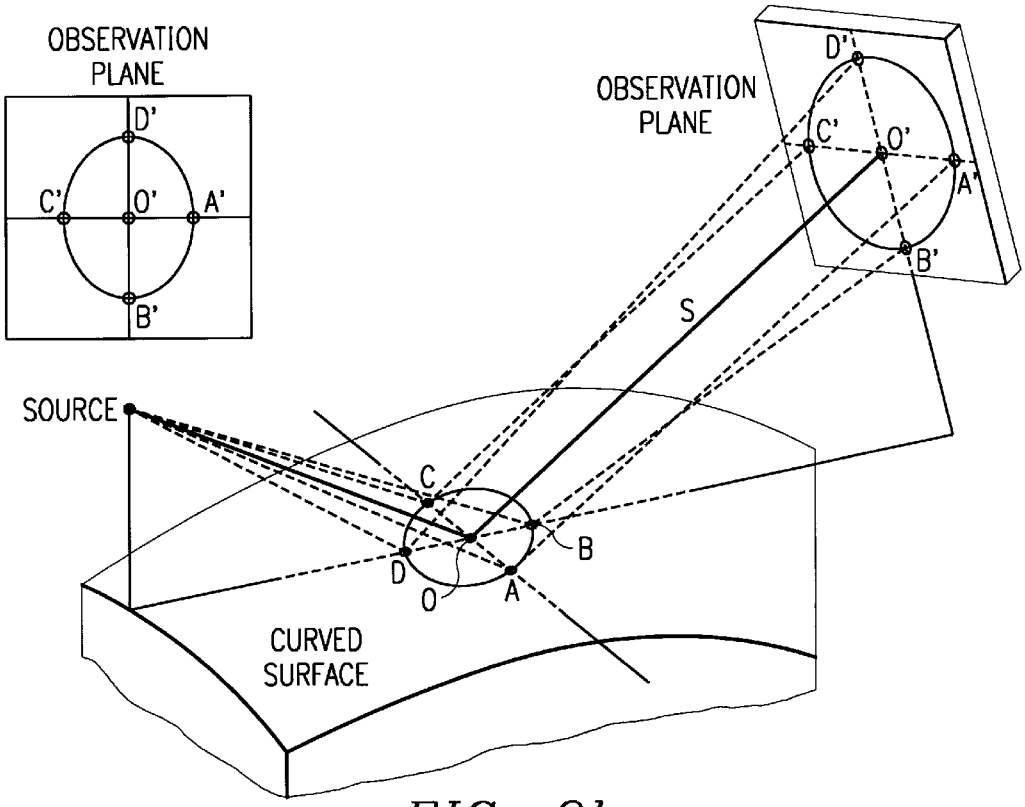
Figure 10:
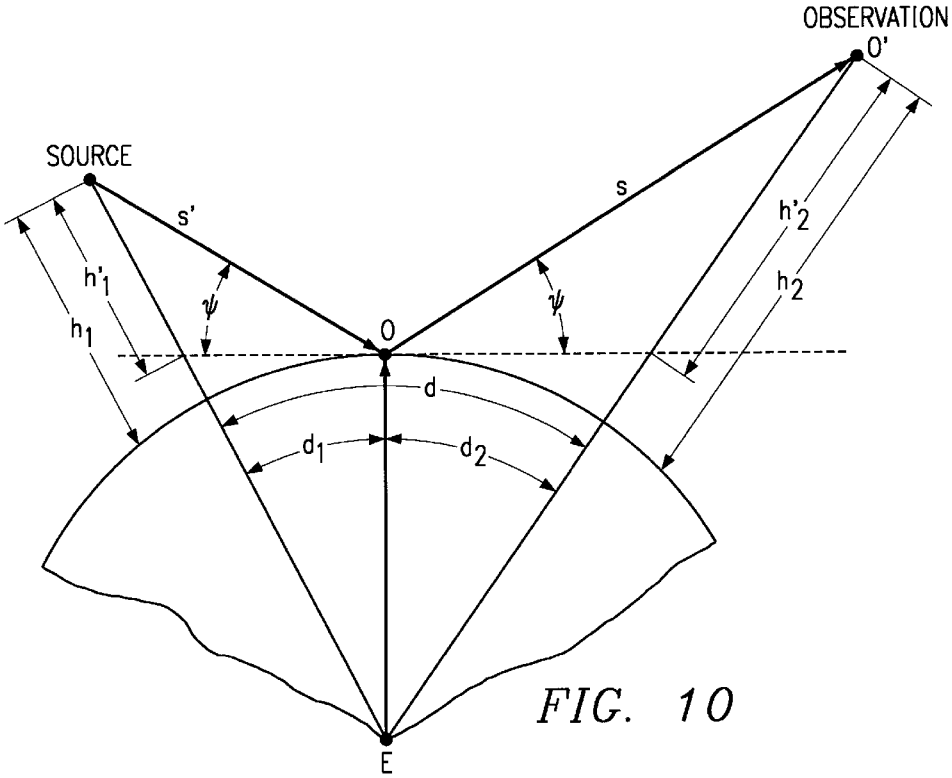
FIG. 10 is a diagram illustrating the geometry for reflections from a spherical surface.

The formula for D can be derived using purely geometrical considerations. It is accomplished by comparing the ray energy density in a small cone 6 reflected from a sphere near the principal point of reflection with the energy density the rays (within the same cone) would have if they were reflected from a surface. Based on the geometrical optics energy conservation law for a bundle of rays within a cone, the reflected rays within the cone will subtend a circle on a perpendicular surface for reflections from a flat surface, as shown in FIG. 9*a*. However according to the geometry of FIG. 9*b*, it will subtend an ellipse for a spherical reflecting surface. Therefore the divergence factor can also be defined as $$D = \frac{E_s}{E_f} = \left[\frac{\text{area contained in circle}}{\text{area contained in ellipse}}\right]^{1/2}$$

where $E_s$=reflectedfieldfrom sphencal surface $E_f$=reflectedfieldfrom flat surface Using the geometry of FIG. 10 and assuming that the divergence of rays in the azimuthal surface (glance vertical to the page) is negligible, the divergence factor can be written as $$D \cong \left[1 + 2*\frac{s's}{ad*\tan\psi}\right]^{-1/2}$$

where Ψ is the grazing angle. Thus the divergence factor of the above takes into account energy spreading primarily in the elevation surface. When d<,<a, then $$s' \cong \frac{h_{1'}}{\sin\psi}$$

$$\tan\psi \cong \frac{h_{1'}}{d_1}$$

$$s \cong \frac{h_{2'}}{\sin\psi}$$

$$\tan\psi \cong \frac{h_{2'}}{d_2}$$

For low grazing angles (Ψ small), sin Ψ=tan Ψ, $$D \cong \left[1 + 2*\frac{h_{1'}*h_{2'}}{a*d*\tan^3\psi}\right]^{-1/2} \cong \left[1 + 2*\frac{d_1^2*d_2}{a*d*h_{1'}}\right]^{-1/2} \cong \left[1 + 2*\frac{d_1^2*d_2^2}{a*d*h_{2'}}\right]^{-1/2}$$

$h_1'$=height of the radiating column above the cylinder surface (with respect to the tangent at the point of reflection)

$h_2'$=height of the observation point above the cylinder (with respect to the tangent at the point of reflection)

d=range (along the surface of the cylinder) between the source and the observation point a=radius of the cylinder.

Ψ=reflection angle (with respect to the tangent at the point of reflection).

$d_1$=distance (along the surface of the earth) from the source to the reflection point $d_2$=distance (along the surface of the cylinder) from the observation point to the reflection point The divergence factor can be included in the formulation of the fields radiated by a horizontal dipole, in the presence of the cylinder, $$E_\psi = j\eta \frac{kI_0 l e^{-jkr}}{4*\pi*r} \sqrt{1-\sin^2\theta \sin^2\Phi}\,[e^{jkh\cos\theta} + DR_h e^{-jkh\cos\theta}]$$

The divergence effect perturbs the value of phase delays and can be estimated by ray tracing, or the use of method of moments programs to effect the best value of delay based on what first side lobe level is desired as well as what target beam width is required by the designer.

The effect of the divergence is to produce a tapered aperture distribution as opposed to a rectangular aperture distribution when all columns are driven at unity and in phase, as in the case of a linear phased array system working in a broadside mode. As the radius of the cylinder increases, the value of the divergence factor increases as in the limit where the cylinder surface starts to converge into a flat surface. So, as the divergence factor decreases, the first side lobe level relationship decreases. As the divergence factor increases, so does the first side lobe level relationship.

We lose the beneficial effect of the divergence factor when the radius grows beyond $3\lambda/2$. In the case of the four driven columns, to compensate for this effect, a series attenuator is placed at the 0° ports of the 4-way combiner when used. The value of attenuation depends on what aperture distribution is desired. In the case of "N" driven column radiators, the series attenuator is placed on those ports that have the least phase shift. Typically, it is desired to have an aperture distribution that is of a raised cosine function. This is achieved by introducing the desired amount of series attenuation on the "lesser" phase shifted ports to the "N" combiner (this is the combiner that is connected to the radiator column). Any desired aperture distribution is accomplished this way, even in the rare case where the divergence factor hinders an arbitrary aperture distribution. The series attenuators can be placed at the appropriate "N" combiner port to effect the desired distribution. Thus, the far-field radiation pattern can be synthesized by the use of the natural divergence factor created by the conic and/or the use of series attenuators at the "N" combiner phase shift ports.

Figure 6C:
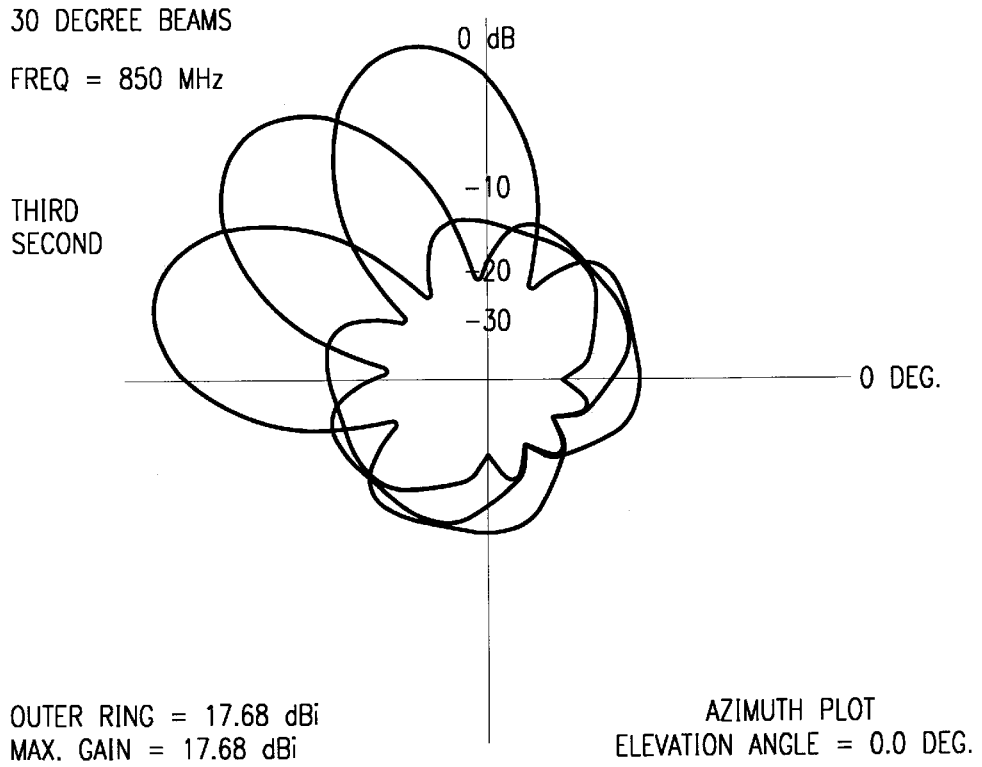

Since the radiator columns are identical around the circumference of the conic (cylinder in this example), the beams are identical to each other and only differ in the fact that the formed beams point in different azimuthal directions. This assumes that each column is set for the same $\theta_m$ or $\theta_e$ which controls or sets the elevation scan departure from normal, as discussed with respect to FIGS. 11*a* and 11*b*. FIG. 6*c* shows three adjacent beams superimposed to illustrate the absence of scan loss, i.e., the amplitude of each adjacent beam is the same independent of azimuthal direction, again, this is not the case with a planar array. Each of the beams are illuminated by exciting the designated input port of the phasing network (beam-forming), assigned to that particular beam/direction.

Figure 7A:
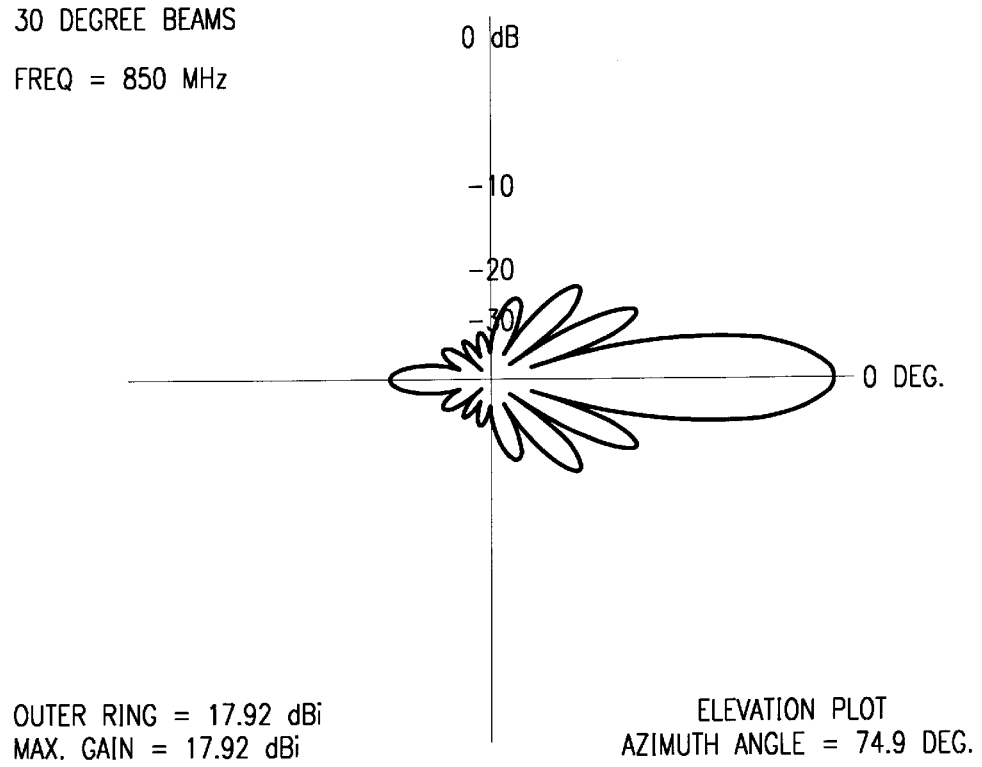
FIGS. 7*a*–7*b* are estimated elevation far-field radiation patterns using the method of moments with respect to the antenna shown in FIG. 1.
Figure 7B:
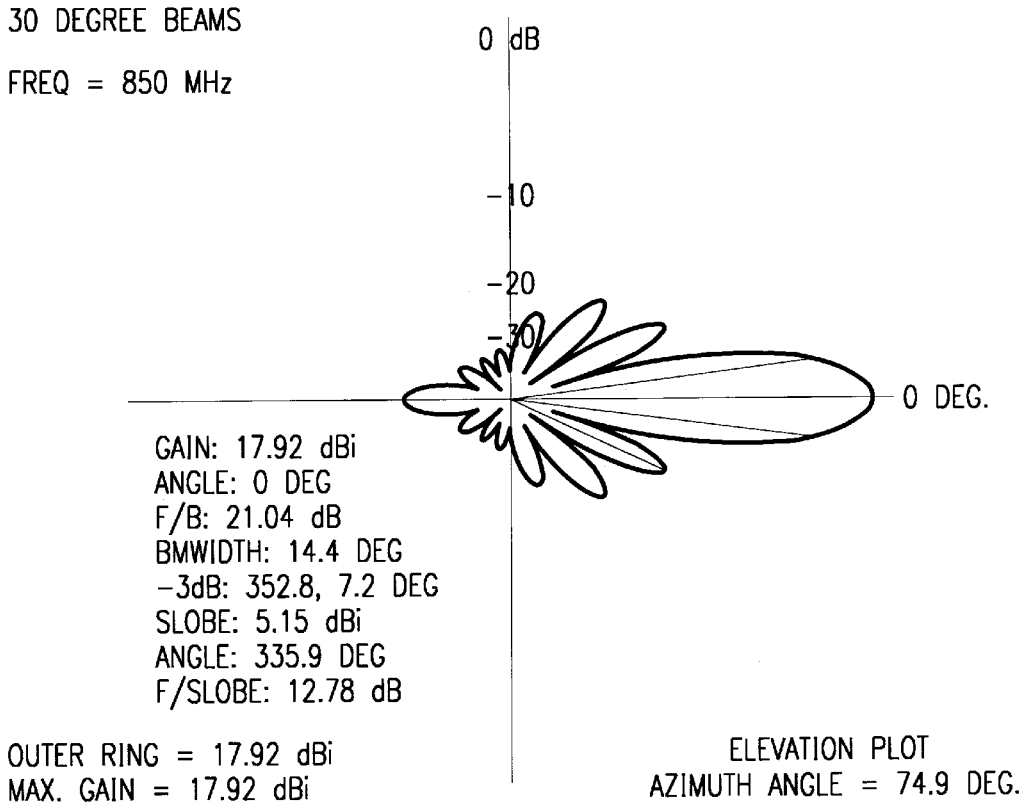
Figure 8A:
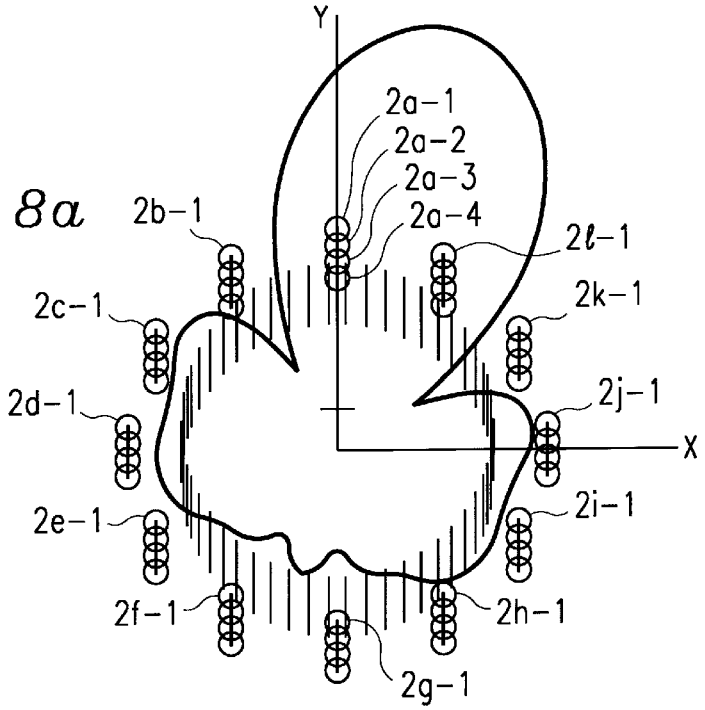

FIGS. 7*a* and 7*b* illustrate the elevation plot along the azimuthal direction of 74.9°, this is like a sectional cut along the beam peak of FIG. 6*a*. The side lobe suppression torus can control the side lobe levels in this plain. The side lobe levels as shown were created by an NEC (numerical electromagnetic code) program using a model illustrated in FIGS. 8*a*, 8*b*, and 8*c*. This model did not use a torus at the upper or lower cylinder edges, thus no side lobe level control in the elevation plain, FIGS. 7*a* and 7*b*, is in effect Returning again to the radiator column feed control network of FIG. 5, it shall be appreciated that this entire control network can be realized in a single unit such as a planar circuit, or "feed ring." Such an embodiment of the control network of FIG. 5 is illustrated in FIG. 17. The use of a such a feed ring to embody the control network is advantageous as it provides a single modular component having couplers to attach to the various antenna columns as well as the input signals. Such a single component provides simple, modular, servicing of the antenna control network in case of failure. Likewise, the use of such modules provides advantages in adapting an antenna to meet particular service needs as will be discussed hereinafter. Of course, the modular feed control network need not be embodied in a ring as illustrated and, in fact, may take on any form deemed advantageous.

As discussed above, the design of the control network, i.e., its topology, may be varied from that illustrated in FIGS. 5 and 17. For example, the excitation of more or less radiator columns than the four excited by this control network topology may be desired. It being appreciated that beam width is a function of how many columns are excited, i.e. the beam being the combined radiation pattern of the excited columns with width being determined azimuthally by the 3 dB half power points, beam width is wider when fewer columns are excited.

Therefore, alternative control networks providing signals to the various radiator columns to be excited having the proper amount of phase delay are illustrated in FIGS. 18 and 19 as feed rings 1800 and 1900 respectively. Feed ring 1800 of FIG. 18 utilizes a combination of three way Wilkinson combiners, illustrated as combiners 1801*a* through 1801*l* and 1802*a* through 1802*l*, to provide an input signal such as provided by inputs 15*a* through 15*l* to three radiator columns.

For example, a signal provided to input 15*c* is split three ways by combiner 1801*c*. It shall be appreciated that as combiner 1801*c* is a Wilkinson combiner, the three signals output therefrom are in phase at ⅓ power. According to the above discussion, the center radiation column should be retarded in phase by an appropriate amount so as to properly sum with the energy radiated by the outer radiator columns also energized. The amount of signal retardation may be determined by the methods discussed above. However, it has been found that retarding the signal supplied to the center radiation column by approximately 60° results in a combined radiation pattern having desirable characteristics.

Therefore, the signal path between the first and second Wilkinson combiners of a particular radiator column, here between combiners 1801*c* and 1802*c*, is provided with an appropriate signal delay means. In the preferred embodiment, this signal path includes an extra length of coax cable, such as length 1803, as necessary to affect the phase shift as determined above. Of course, other delay means may be used, such as the aforementioned SAW device. Thus, with this delay in the signal path, the signal originally provided at input 15*c* is provided to combiner 1802*c*, associated with radiation column 2*c*, with a phase lag as compared to the signals provided to combiners 1802*b* and 1802*d*, associated with radiation columns 2*b* and 2*d* respectively. It shall be appreciated that it is the connection between the two combiners associated with a particular radiation column which introduces the delay as this connection is always identified with the center column of an excited array.

Feed ring 1900 of FIG. 19 utilizes a combination of two way Wilkinson combiners, illustrated as combiners 1901*a* through 1901*l* and 1902*a* through 1902*l*, to provide an input signal such as provided by inputs 15*a* through 15*l* to two radiator columns.

For example, a signal provided to input 15*a* is split two ways by combiner 1901*a*. It shall be appreciated, although combiner 1901*a* is a Wilkinson combiner providing two ½ power in phase signals, that the symmetry associated with exciting only two radiator columns remediates the need of phase delaying a signal in order to provide a desired wave front. Therefore, the signals provided to radiator columns 2*a* and 2*b*, through combiners 1902*a*, 1902*b*, and 1901*a*, are in phase.

As previously discussed, the various control networks feeding input signals to the antenna array of the present invention realize different beam widths utilizing the same basic antenna structure. Specifically, the excitation of four radiation columns from an input signal, as is provided by the control network illustrated in FIG. 17, produces antenna beams of approximately 30° azimuthal width. Likewise, the excitation of three radiation columns from an input signal, as is provided by the control network illustrated in FIG. 18, produces antenna beams of approximately 45° azimuthal width. Similarly, the excitation of two radiation columns from an input signal, as is provided by the control network illustrated in FIG. 19, produces antenna beams of approximately 60°. Of course, beam widths other than those described may be realized by exciting a different number of antenna columns, and/or by providing a different number of antenna columns around the periphery of the antenna structure.

It shall be appreciated that a particular beam width may be desired depending upon the service which the antenna system is to provide. Therefore, an antenna array according to the present invention may advantageously be adapted to receive different ones of the above described feed rings. For example, an antenna "shell" having the antenna columns and ground plane may include connectors and necessary support structure to accept any one of a variety of control networks, such as the preferred rings, to form a completed antenna structure. The selection of the control network to combine with the antenna shell will depend on the use contemplated for the antenna structure and, therefore, the desired beam widths.

Moreover, it is possible to have two or more such beam width selections available with one such antenna structure. For example, where multiple services are to be provided from a single antenna structure, different beam widths for each such service may be advantageous. To service these differing beam width needs, multiple feed rings could be utilized. Where three different beam widths are desired, for example, 60°, 45°, and 30° degree beams could be arranged by the appropriate feed rings and their corresponding individual topologies.

Figure 20:
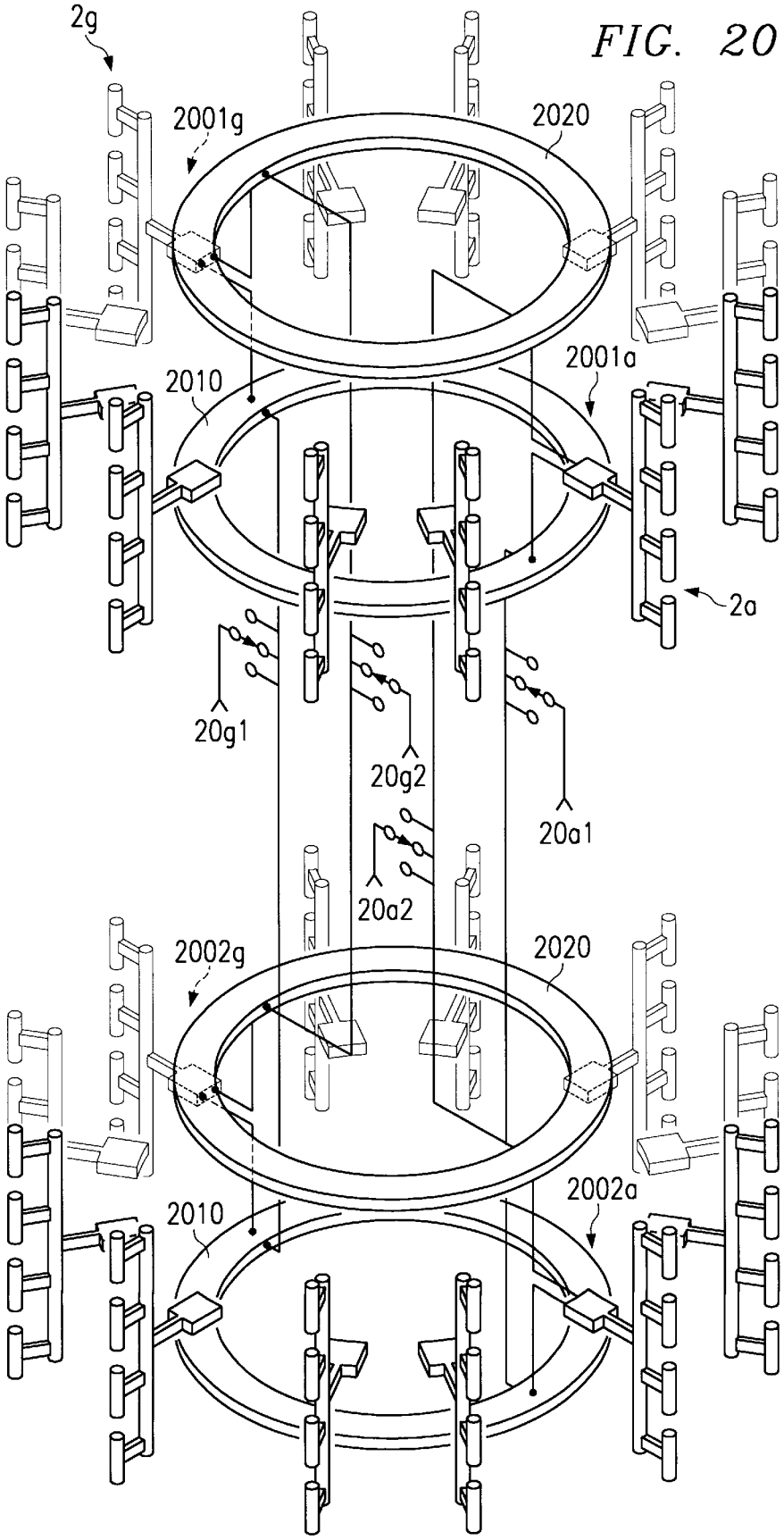
FIG. 20 shows the use of multiple feed rings to provide various beam widths from a single inventive antenna.

FIG. 20 illustrates the stacking of feed rings to provide the different beam widths associated with various input signals, i.e., different services. Feed rings 2010 and 2020 each energize a different number of radiator columns for a particular input signal. For example, feed ring 2010 may provide energization of four radiator columns, such as provided by the circuitry of feed ring 1700 of FIG. 17. Likewise, feed ring 2020 may provide energization of two radiator columns, such as provided by the circuitry of feed ring 1900 of FIG. 19. Therefore, a signal input at 20*a*1 or 20*g*1 would result in a 30° beam while a signal input at 20*a*2 or 20*g*2 would result in a 60° beam.

In order to simultaneously provide signals from multiple feed rings to the antenna columns of the present invention, combiners 2001*a*, 2002*a*, 2001*g*, and 2002*g*, corresponding to each radiation column subsection, are provided at the outputs of each feed ring. It shall be appreciated that the antenna system of FIG. 20 illustrates the multiple subsection electronic down-tilt method described previously. However, it shall be understood that multiple feed rings providing different beam widths may be used without the illustrated down-tilt system.

It shall be appreciated that utilizing a single antenna structure to synthesize a variety of antenna systems, i.e., antennas having different beam widths, is advantageous as only a single site need be acquired for erecting the multiple service antenna system. As more communication services are utilized, it is expected that such antenna sites will become more and more difficult to obtain.

Returning again to the structure shown in FIG. 13 which illustrates an interleaved structure of the radiator columns, it shall be appreciated that the individual antenna elements associated with each subcolumn illustrated in FIG. 13 are slanted either left or right. This structure is more power efficient, as discussed above, but it has lost the linear (vertical) polarization of the structure of FIG. 1 where all of the dipoles are oriented in the same direction. For example, antenna elements 2*a*–U are slanted left and antenna elements 2*a*–L are slanted right.

Figure 15A:
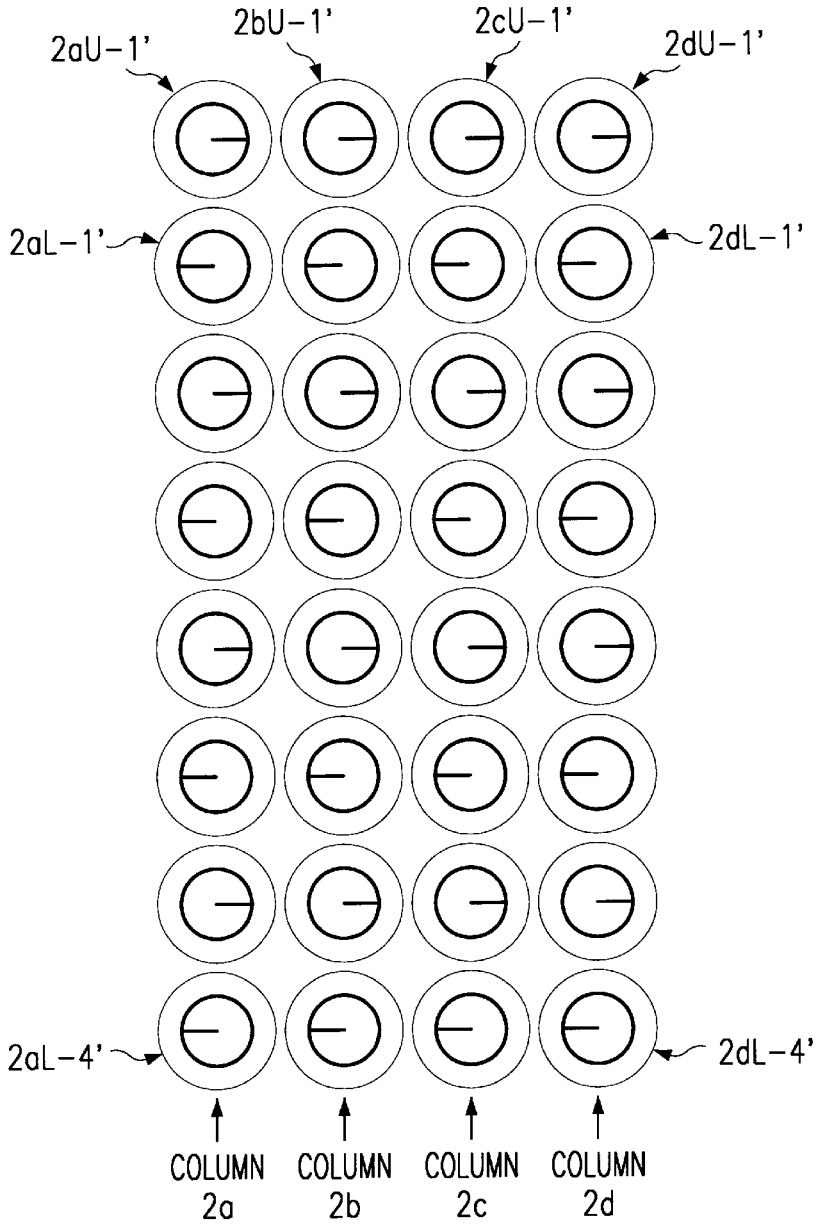
FIGS. 15*a*–15*c* show helical coil transmission structures.
Figure 15B:
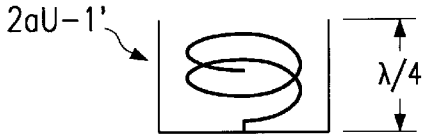
Figure 15C:
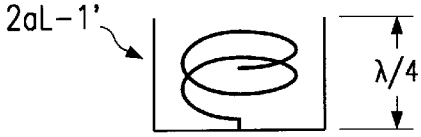

This zig-zagged structure has lost linear polarization, and instead provides elliptical polarization. A subset of elliptical polarization is called circular polarization. This is created by a dipole which is laying sideways (or on a slant) and the backdrop for it is the cylinder. Note however, helical coils can substitute for the dipoles in the generation of circular polarization. This is shown in FIG. 15*a* where the coils are a direct replacement for the elements of FIG. 13. FIGS. 15*b* and 15*c* show oppositely directed coils as used in FIG. 15*a*.

This elliptical polarization is a fortuitous byproduct and is combined with an efficient power structure. The cellular industry started with mobile radios having antennas somewhere on the back or the top of a car. This antenna was vertically polarized. So a vertical antenna system was good. Now, however, cellular phones are truly mobile and the antennas are mounted on the telephone. Users hold the antenna diagonal to the ear so that the antenna is actually cocked at an angle which matches the angle at which the dipoles are cocked. Energy from the cocked dipoles of the interleaved antenna rotates as fast as the operating frequency. Thus, a person could be lying on his back or hanging from a tree and the circular polarization will pick up his/her signal. This is the same polarization as is used by FM radio stations in the 88 to 108 MHz band, which have been using circular polarization for the past 12 years. With the system devised herein, cellular radio will be able to use circular polarization.

Moreover, such an antenna system could be utilized to improve signal quality through the use of polarization diversity within any beam. For example, by employing slant-left 45 degree/slant-right 45 degree polarization (one polarization state is 45 degrees to the left of a reference, the other state is 45 degrees to the right of the reference) within a single beam, advantages of signal diversity can be realized. Of course, vertical/horizontal polarization can be used as well, if desired.

Where each subcolumn of a radiating column provides different polarization, such as the aforementioned slant-left/slant-right polarization, the energization of two such subcolumns having different polarization resulting in polar diversity. However, it shall be appreciated that signals provided to alternating input ports of the control network illustrated in FIG. 12, as previously discussed, will excite alternating subcolumns of the radiating columns. Therefore, in order to provide polar diversity, two control networks as illustrated in FIG. 12 may be utilized. Of course, such a system requires double the number of radiation columns. Therefore, in order to provide polar diversity utilizing the interleaved control network of FIG. 12, 48 radiation columns are required (12 original columns being doubled, by the use of the interleaved control network, resulting in 24 subcolumns again doubled, through the use of two interleaved control networks to provide polar diversity, resulting in a total of 48 columns).

Figure 21:
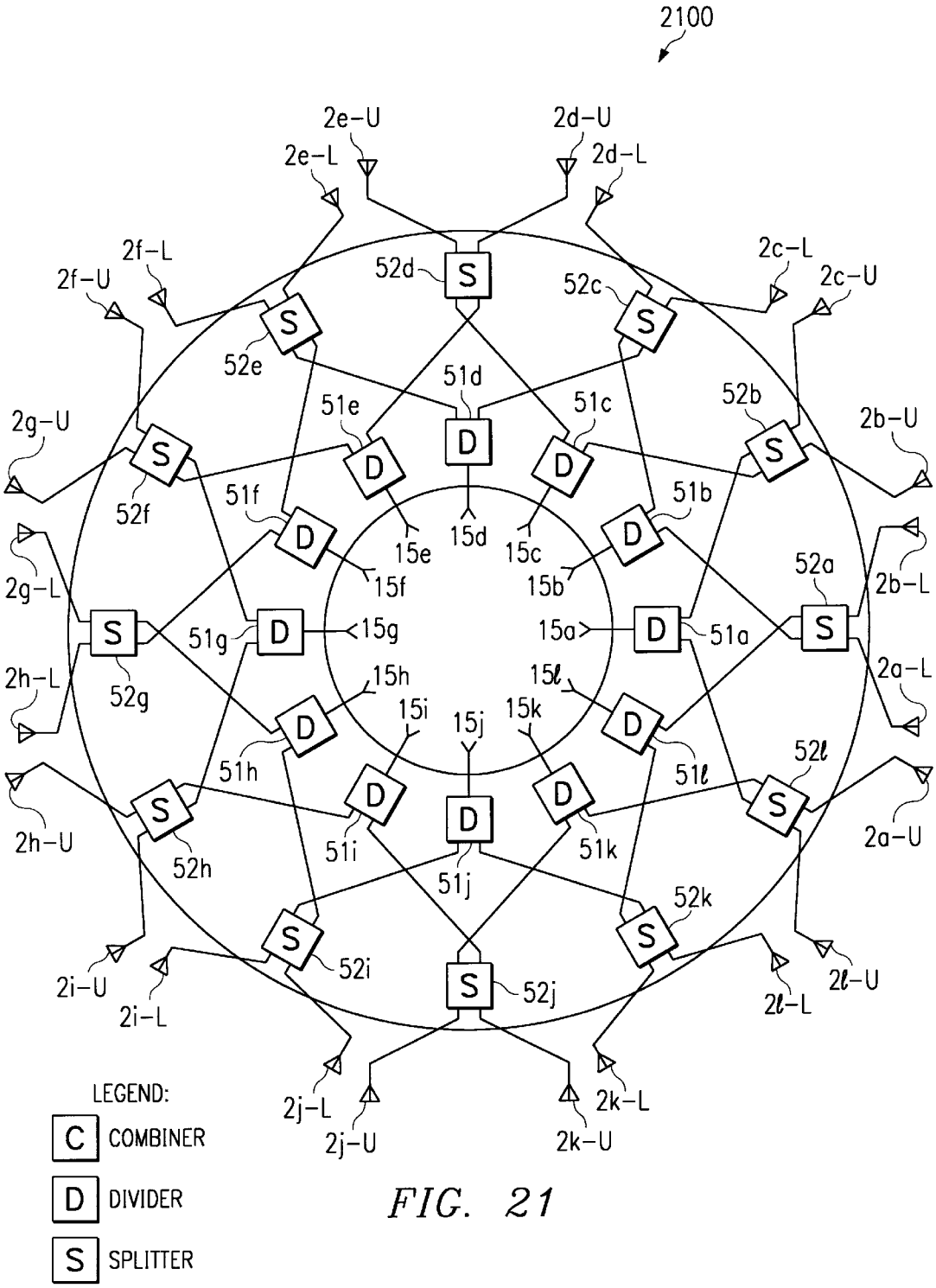
FIG. 21 shows the interleaved feed control network of FIG. 12 as a planar circuit feed ring.

Referring to FIG. 21, the control network illustrated in FIG. 12 is shown as a feed ring. It shall be appreciated that such an embodiment of this control circuit shares the advantages previously mentioned with respect to the non-interleaved control circuit of FIG. 17, such as providing modularity for choices in beam width or stacking for provision of multiple beam widths. Furthermore, such an embodiment provides a convenient means by which multiple such control circuits may be provided to an antenna structure in order to provide polar diversity.

It shall be appreciated that by utilizing two such interleaved feed rings, wherein the antenna subcolumns associated a first such ring have the opposite polarization as the corresponding subcolumns associated with a second such ring, the above described polar diversity may be realized. For example, where the feed ring of FIG. 21 is interleaved with a second feed ring, this second feed ring would be identical to that of FIG. 21 except that every antenna subcolumn of a particular polarization (polarization being indicated by the U or L designation) would be replaced by an antenna subcolumn of the opposite polarization.

Figure 22:
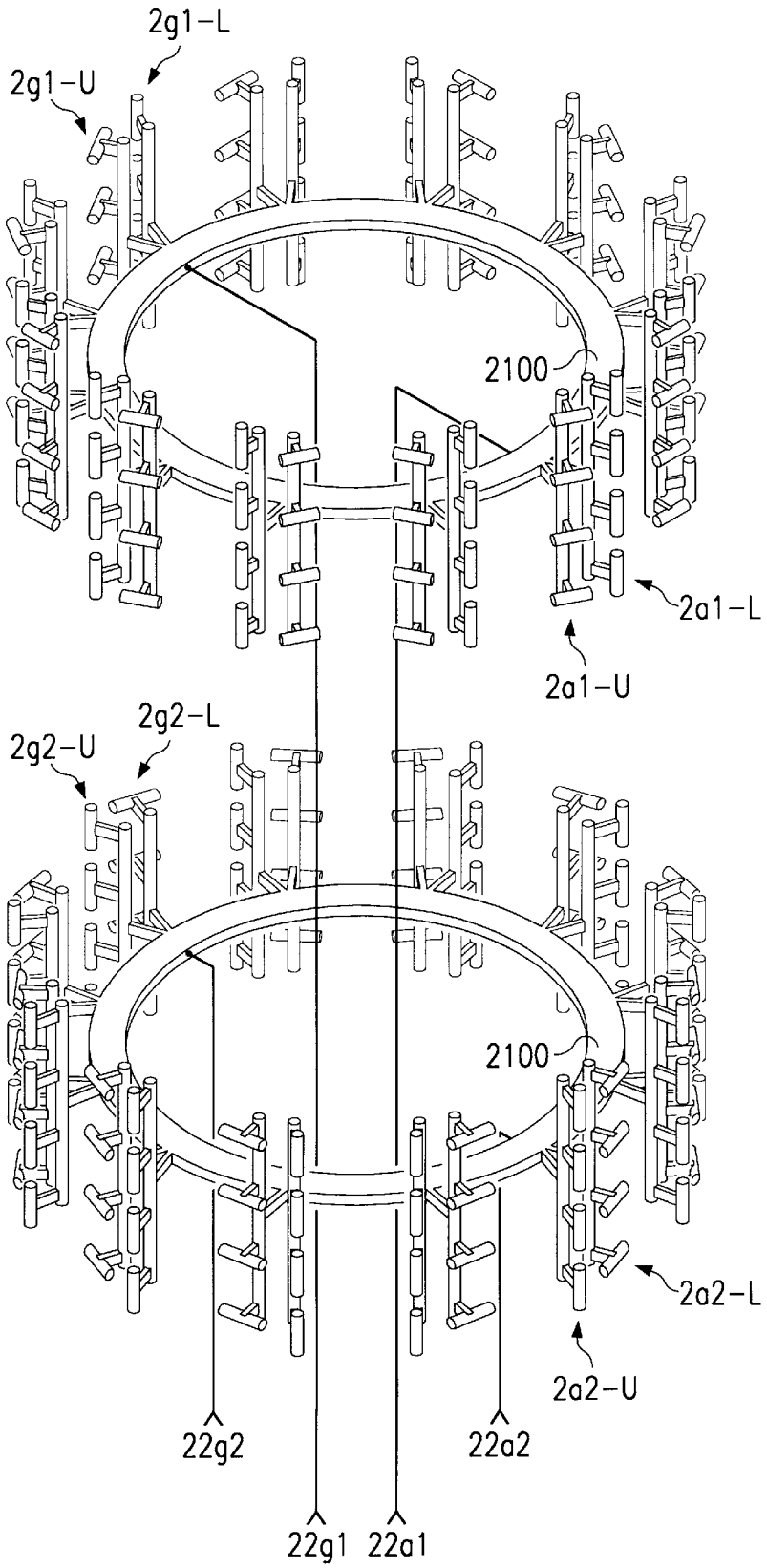
FIG. 22 shows the use of multiple interleaved feed rings to provide polar diversity.

Directing attention to FIG. 22, two such interleaved feed rings being stacked to provide polar diversity are shown. Although only two radiation columns each are illustrated in order to simplify the drawing, it shall be appreciated that the rings in fact feed twelve interleaved radiation columns each of which include two subcolumns.

A signal at connector 22*a*1 will be associated with antenna subcolumn 2*a*1–U (having vertical polarization for example) and a corresponding signal at connector 22*a*2 will be associated with antenna subcolumn 2*a*2–L (having horizontal polarization for example) to result in polar diversity. The signals at connectors 22*a*1 and 22*a*2 may be input into the diversity ports of a diversity receiver to provide polar diversity, for example.

Of course, although not shown in FIG. 22, a signal at connector 22*a*1 will also be associated with subcolumns 2*b*1–U, 2*c*1–U, and 2*l*1–U, of the upper ring. Likewise, a signal at connector 22*a*2 will also be associated with subcolumns 2*b*2–L, 2*c*2–L, and 2*l*2–L, of the lower ring. The signal paths providing this association can be clearly seen in FIG. 21.

Although the present invention has been discussed with reference to dipole and helical coil elements, there is no limitation to such elements. For example, a micro strip patch may be used as a direct replacement for the above described dipoles. The patch can be used to generate linear, circular, or dual polarizations. Variation between these states is accomplished by careful location of the number and location of the electrical feeds to the patch.

Figure 23A:
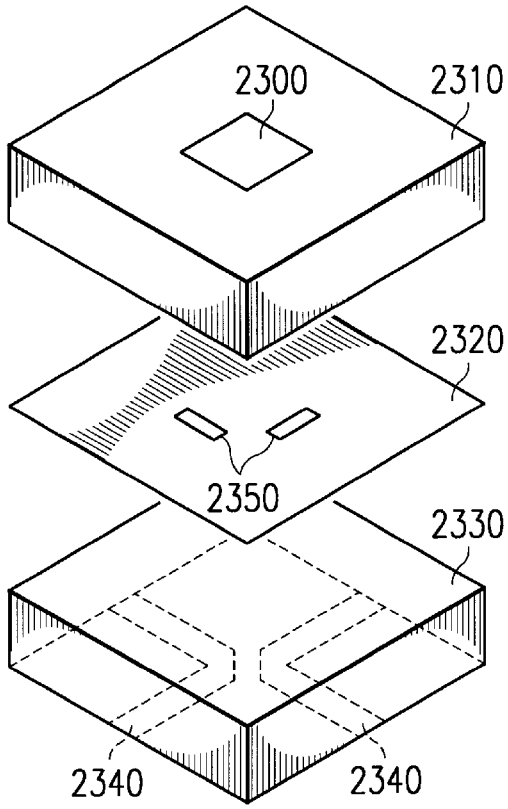
FIGS. 23*a*–23*b* show a micro strip patch antenna element adapted to provide dual or circular polarization.

Directing attention to FIG. 23*a* an exploded view of a preferred embodiment of a micro strip patch adapted to provide dual or circular polarization is illustrated. The patch antenna element includes radiator element 2300 which may be any isolated metallic patch, such as copper. Radiator element 2300 is electrically isolated through the use of dielectric material 2310. Ground plane 2320, having slits 2350, is provided below dielectric material 2310. Dielectric material 2330 is provided below ground plane 2320 to electrically isolate electrical feeds 2340, which may be micro strips for example, from ground plane 2320. It shall be appreciated that ground plane 2320 may be ground surface 13 illustrated in FIG. 1.

Figure 23B:
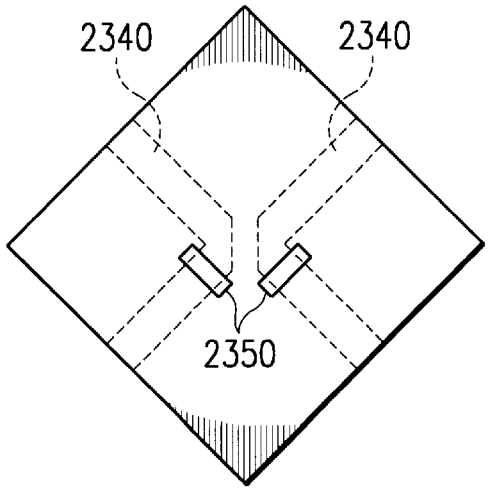

It shall be understood that it is the combination of the two electrical feeds 2340 as well as the placement of slits 2350 that provide the patch with circular or dual polarization. Referring to FIG. 23*b*, it can be seen how slits 2350 are placed in relation to electrical feeds 2340. Of course, other configurations of a micro patch antenna element may be utilized with the present invention.

The two slits 2350 being orthogonal provide polar diverse signals to electrical feeds 2340. If each of these signals is provided to the diversity ports of a diversity receiver, for example, polar signal diversity may be utilized. Alternatively, if a 90° phase shift is introduced in one of these electrical feeds, circular polarization is realized.

The beam width of the patch is rather wide, which is why it is attractive in fabrication of array antennas. As electrical frequencies increase, dipole arrays become more difficult to construct because of the small dimensions. Patches tend to replace dipoles in such situations, as they are rather simple to make. For example, the patch illustrated in FIG. 23*a* may actually be constructed as part of a strip or sheet of such patch elements simply by extending the various substrate elements and locating more radiator elements there on. Hence, a patch array would be a natural extension of this concept at higher frequencies.

Moreover, although the use of twelve radiation columns has been disclosed, the present invention is equally adaptable for use with any number of such radiation columns. Likewise, the use of twelve inputs is not a limitation of the present invention. For example, where a control network providing wide beams, such as the above described 60° beams, it may be desirable to provide only six inputs associated with substantially non-overlapping 60° beams. Of course, the topology of the control network may be adapted to accept only the above mentioned six inputs by removing the associated combiners and signal paths or, alternatively, alternating ones of the described twelve inputs may be ignored to achieve the same result.

Where a feed ring is adapted to accept a number of inputs less than the number of beams desired, it shall be appreciated that multiple such feed rings may be stacked, utilizing combiners at the radiator column connectors, to provided additional beams. For example, two of the six input embodiments providing six 60° beams, described above, may be stacked to provide twelve inputs associated with twelve partially overlapping 60° beams.

Figure 24:
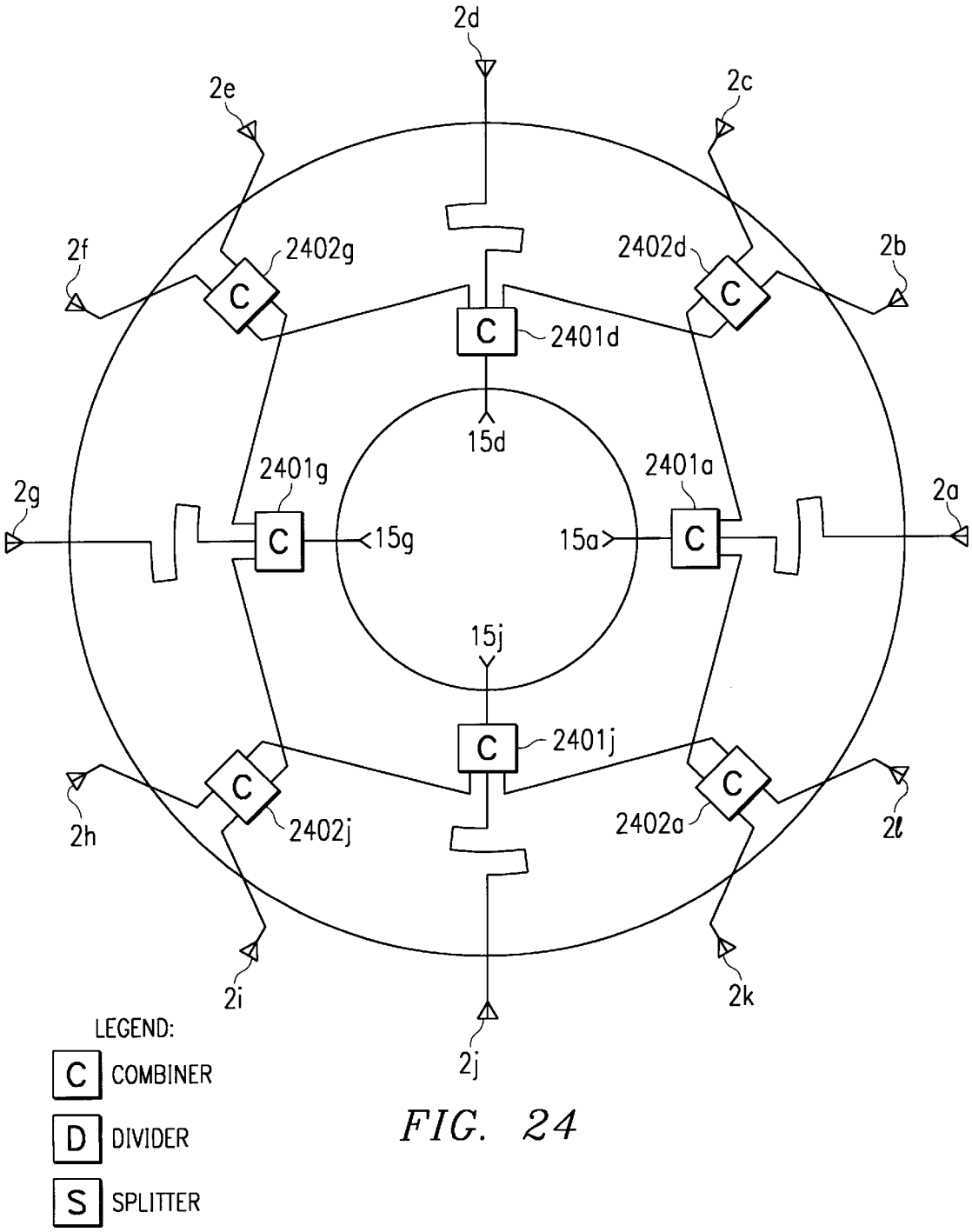
FIG. 24 shows a feed control network providing a beam associated with five radiator columns.

It shall be appreciated that the present invention is not limited to the excitation of the 2, 3, and 4 radiator columns from a single signal as illustrated in the preferred embodiments. For example, the present invention is equally adaptable to illuminate 5 columns from a single signal as illustrated in the alternative embodiment of FIG. 24 utilizing a combination of three way Wilkinson combiners 2401*a*, 240*d*, 2401*g*, and 2401*j* and hybrid combiners 2402*a*, 2402*d*, 2402*g*, and 2402*j*. It shall be appreciated that the embodiment illustrated here includes only four input connectors and thus define four beams. As described above, three of these rings may be stacked to provide twelve beams. Alternatively, additional circuitry associated with additional inputs may be added to provide twelve beams from a single feed ring.

Although the present invention has been discussed with reference to the reception and transmission of analogue signals through beam forming networks, it shall be appreciated that the use of digital adaptive array technology may be used. Moreover, adaptive array technology may be used in combination with the aforementioned analogue beam forming networks to provide a hybrid antenna system. For example, directing attention to FIG. 3, feed networks 32*a*–32*l* coupled to feed systems 33*a*–33*l* of the Tx portion of the antenna system may be the analogue feed rings discussed above, whereas feed networks 5*a*–5*l* coupled to feed systems 4*a*–4*l*, might utilize digital adaptive array technology.

Additionally, the digital adaptive array feed network may be in combination with an analogue feed network. For example, the feed networks of the Rx portion of the antenna structure in FIG. 3 may include both an analogue feed network and a digital feed network, such as by stacking the feed rings as described above. Here, for example, the digital adaptive techniques may be used only for certain communication services, or only when needed, and the analogue feed system utilized otherwise.

The use of digital adaptive techniques may be desirable in service enhancement through such features as enhanced beam forming/steering and null steering to cancel interference and improve signal quality. For example, when used in the receive signal path, digital adaptive techniques may be beneficial in directing very narrow beams suitable for use in such services as enhanced 9-1-1 (E-9-1-1). As discussed above, the system might typically operate through the analogue beam forming networks until activation of the E-9-1-1 system. Thereafter, the digital adaptive feed network may be utilized to direct a very narrow antenna beam toward the unit instigating the service to aid, for example, in an automated location determination.

Therefore, in an alternative embodiment, the feed network is comprised of components to provide digital adaptive techniques. For example, feed networks 5*a*–5*l* may each include receiver 2901, mixer 2902, local oscilator (LO) 2903, and analogue to digital converter (ADC) 2904. Receiver 2901, mixer 2902, and LO 2903 may be utilized to filter and convert a signal received on an associated radiator column to an intermediate frequency suitable for conversion to a digital bit stream by ADC 2904. Thereafter, the digital bit stream may be provided to the digital beam forming system through corrector 15*a*. Once in digital form, the application of a multitude of digital signal processing techniques and algorithms to the spatial domain data may be made.

Of course, the digital bit streams of each radiator column may be multiplexed for down-link transmission, rather than provided through a separate antenna down-link connection, if desired. Likewise, ADC 2904 may be provided in a base station installation rather than within the antenna structure, if desired. Here an intermediate frequency would provide the received signal from the antenna structure to the base station.

Figure 29:
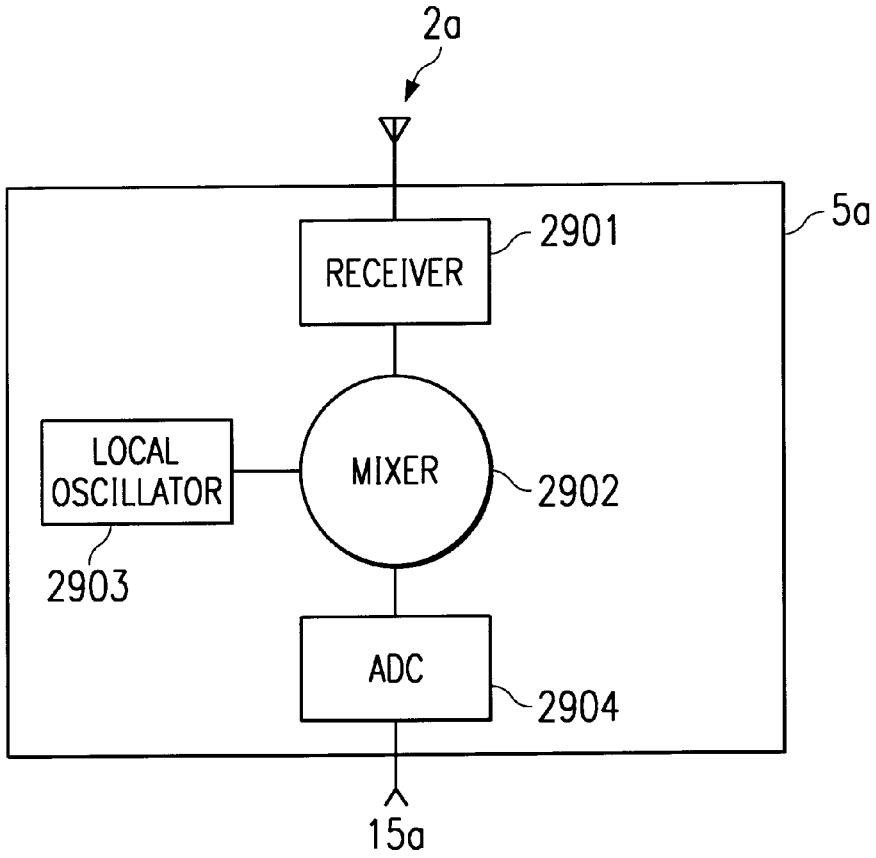
FIG. 29 shows an alternative embodiment of a feed network adapted to utilize digital adaptive techniques.

An algorithm could be utilized to multiply the bit streams associated with particular radiator columns (i.e., adjusting their associated amplitude and/or phase information) in order to sum them together to form beams or even steer nulls into interfering beams. This beam forming algorithm may be provided in a processor based system (not shown) located in a base station coupled to the antenna structure or, alternatively, may be provided within the antenna structure itself. For example, feed networks 5*a*–5*l* configured as illustrated in FIG. 29 may be provided on a modular feed network, such as the aforementioned feed rings. The processor based system may also be provided on the modular feed network, providing digital beam forming. As such, by including digital to analogue conversion of the digitally formed beam signals, analogue signals could be provided through connectors 15*a*–15*l* down to a base station, etcetera. Therefore, although utilizing digital adaptive techniques, the digital feed network could appear transparent to the coupled communication system.

Although the present invention and its advantages have been described in detail, it should be understood that various changes, substitutions and alterations can be made herein without departing from the spirit and scope of the invention as defined by the appended claims.

What is claimed is:

1. A multibeam antenna system having a plurality of radiating structures, said antenna system comprising:

signal providing means, selected from a plurality of signal providing means, for accepting an input signal and providing said input signal to a preselected group of said radiating structures, said group of radiating structures selected such that excitation by said input signal radiates a signal from said antenna system combining to form a wave front having a predetermined beam width, wherein ones of said sigmal providing means provide said input signal to different preselected groups of said radiating structures to thereby provide different predetermined beam widths and other ones of said signal providing means provide said input singal to same preselected groups of said radiating structures to thereby provide same predetermined beam widths; and means for removably accepting different ones of said plurality of signal providing means in said antenna system, wherein said plurality of radiating structures are provided in a predetermined array configuration adapted to removably accept said different ones of said plurality of signal providing means without altering said predetermined array configuration.

2. The antenna system of claim 1, wherein said accepting means provides removable coupling of said signal providing means to said radiating structures.

3. The antenna system of claim 1, wherein said accepting means accepts said different ones of said signal providing means one after the other such that one signal providing means may replace another of said signal providing means.

4. The antenna system of claim 1, wherein said signal providing means comprise:

a planar circuit wherein connectors are provided to accept a coupled communication system signal and additional connectors are provided to couple to ones of said plurality of radiating structures.

5. The antenna system of claim 4, wherein said planar circuit is in the form of a feed ring having an inside circumference having said communication system connectors disposed therein and an outside circumference having said radiating structure connectors disposed thereon.

6. The antenna system of claim 1, wherein said accepting means accepts a first and second said signal providing means of said plurality of signal providing means simultaneously.

7. The antenna system of claim 6, further comprising:

means for combining an output of said first signal providing means associated with a particular radiating structure of said plurality and an output of said second signal providing means associated with the same said particular radiating structure, wherein said preselected group of said radiating structures provided an input signal by each one of said first and second signal providing means is different, said different groups of radiating structures each being selected such that wave fronts having different beam widths may be formed by signals input into each said signal providing means.

8. The antenna system of claim 7, wherein at least one of said first and second signal providing means comprise Wilkinson and hybrid combiners coupled to provide signals to non-interleaved radiating structures.

9. The antenna system of claim 6, further comprising:

a first subsection of each of said radiating structures, wherein said first signal providing means provides an input signal to said first subsection of said preselect group of said radiating structures;

a second subsection of each of said radiating structures, wherein said second signal providing means provides an input signal to said second subsection of said preselect group of said radiating structures; and signal delay means for introducing a phase differential between the signal provided by said first signal providing means to said first subsections of said preselect group of radiating structures and said second signal providing means to said second signal providing means to said second subsections of said preselect group of radiating structures, wherein said phase differential is operable to steer a beam radiating from said preselect group of radiation structures.

10. The antenna system of claim 9, wherein said signal delay means further comprise:

means for adjusting said phase differential operable to provide adjustable beam steering.

11. The antenna system of claim 10, wherein said phase differential adjusting means comprises:

a common signal feed path between said first and second signal providing means;

a plurality of tap positions in said common signal feed path disposed to provide differing signal path lengths to said first and second signal providing means from a common input; and switching means for selectably coupling said common input and a tap position of said plurality of tap positions.

12. The antenna system of claim 6, further comprising:

a first substructure of each of said radiating structures having a first polarization, wherein said first signal providing means provides an input signal to said first substructure of said preselect group of radiating structures; and a second substructure of each of said radiating structures having a second polarization, wherein said second signal providing means provides an input signal to said second substructure of said preselect group of radiating structures, and wherein polar diversity is realized by simultaneous excitation of said first and second substructures of a radiating structure.

13. The antenna system of claim 12, wherein said first and second signal providing means comprise Wilkinson and hybrid combiners coupled to provide a signal to interleaved radiating substructures.

14. The antenna system of claim 1 further comprising:

a first subsection of each of said radiating structures;

a second subsection of each of said radiating structures; and signal delay means for introducing a phase differential between the signal provided to said first and second subsections.

15. The antenna system of claim 14, wherein said first and second subsections are provided a signal from a same said signal providing means having said signal delay means disposed in the signal path between said signal providing means and each of said second subsections.

16. The antenna system of claim 1, wherein at least one of said plurality of signal providing means comprises:

means for communicating a digital bit stream between said signal providing means and a coupled communication system.

17. An antenna signal feed system for communicating signals between a communication system and a multibeam antenna having a plurality of radiating columns spaced circumferentially around a center point, said system comprising:

a first antenna feed network module having a first set of connectors and a second set of connectors;

each connector of said second set being associated with a particular radiating column of said plurality; and each connector of said first set being in communication with predetermined connectors of said second set, wherein a beam width of said multibeam antenna is a function of the number of said predetermined connectors of said second set in communication with a connector of said first set.

18. The system of claim 17, wherein said predetermined connectors of said second set are associated with at least two adjacent radiating columns.

19. The system of claim 17, wherein said first module is a planar circuit adapted to form a feed ring wherein each connector of said first set is in communication with a same number of connectors of said second set.

20. The system of claim 19, wherein said communication between said first and second sets of connectors include Wilkinson and hybrid combiners.

21. The system of claim 19, wherein said communication between said first and said second sets of connectors include the use of multiple Wilkinson combiners.

22. The system of claim 17, wherein said first module is selected from a plurality of antenna feed network modules providing communication to different numbers of said second set of connectors from a connector of said first set.

23. The system of claim 22, wherein said different numbers of connectors of said second set in communication with a connector of said first set are selected from the group consisting of 4, 3, and 2.

24. The system of claim 17, further comprising:

a second antenna feed network module having a third set of connectors and a fourth set of connectors;

each connector of said fourth set being associated with a particular radiating column of said plurality; and each connector of said third set being in communication with predetermined connectors of said fourth set.

25. The system of claim 24, wherein a connector of said second set of connectors of said first module is associated with a same antenna column as a connector of said fourth set of connectors of said second module.

26. The system of claim 25, further comprising:

a combiner coupled to said connector of said fourth set of connectors of said first module and to said connector of said second set of connectors of said second module associated with said same antenna column, wherein multiple beam widths are simultaneously provided by said antenna, different ones of said multiple beam widths being associated with said first and second modules.

27. The system of claim 26, further comprising:

means for providing a phase differential between a common signal provided to said first and second module; and at least one subdivision of said radiating columns providing at least two column subsections, wherein said second set of connectors of said first module are associated with a first subsection and said fourth set of connectors of said second module are associated with a second subsection, and wherein said phase differential in said common signal is adapted to provide beam steering of an antenna beam.

28. The system of claim 24, wherein each radiating column further comprises:

a first subcolumn having antenna elements disposed to provide a particular polarization, said second set of connectors of said first module being associated therewith; and a second subcolumn having antenna elements disposed to provide a different polarization than said first subcolumn, said fourth set of connectors of said second module being associated therewith, wherein polar diversity is realized by a common signal being provided to said radiating column having antenna elements disposed to provide different polarity.

29. The system of claim 17, further comprising:

at least one subdivision of said radiating columns providing at least two column subsections; and means for providing a phase differential between a signal communicated between said first module and ones of said radiator columns wherein a first column subsection is provided a phase shifted same signal as a second column subsection.

30. The system of claim 17, wherein said first module is adapted to communicate signals utilized in digital adaptive techniques.

31. The system of claim 30, wherein said first module comprises:

a receiver providing conversion between an intermediate frequency and a radio frequency.

32. A method for providing multiple beams from an antenna system having a plurality of radiating structures disposed in an antenna array, said method comprising the steps of:

selecting a first signal feed circuit from a plurality of signal feed circuits, each signal feed circuit of said plurality adapted to provide signal communication between an interface of a first set of interfaces and a preselected number of interfaces of a second set of interfaces, said preselected number of interfaces of said second set being selected such that a predetermined beam width of said multiple beams is defined when said signal feed circuit is coupled to said antenna system, wherein said first signal feed circuit is a planar circuit adapted to form a ring wherein said first set of interfaces are disposed about an inside circumference and said second set of interfaces are disposed about an outside circumference; and coupling said first selected signal feed circuit to said antenna system such that each of said second set of interfaces is in communication with a radiating structure of said plurality of radiating structures, wherein said coupling step provides for coupling any of said plurality of signal feed circuits without changing said antenna array.

33. The method of claim 32, further comprising:

selecting a second signal feed circuit from said plurality of signal feed circuits; and coupling said second selected signal feed circuit to said antenna system such that each of said second set of interfaces of said second signal feed circuit is in communication with a radiating structure of said plurality of radiating structures.

34. The method of claim 33, further comprising the step of:

combining a signal path of said first signal feed circuit associated with a particular radiating structure of said plurality and a signal path of said second signal feed circuit associated with the same said particular radiating structure.

35. The method of claim 34, wherein said antenna system provides different beam widths to signals associated with said first signal feed circuit and said second signal feed circuit.

36. The method of claim 34, wherein said first signal feed circuit utilizes digital beam forming techniques and said second signal feed circuit utilizes analogue beam forming techniques.

37. The method of claim 35, wherein at least one of said first and second signal providing means comprise Wilkinson and hybrid combiners coupled to provide signals to non-interleaved radiating structures.

38. The method of claim 33, further comprising the steps of:

subdividing each radiating structure of said plurality into a first subsection and a second subsection, wherein said first signal feed circuit is coupled to said first subsections and said second signal feed circuit is coupled to said second subsections; and introducing a phase shift between a signal provided by said first signal feed circuit to ones of said first subsections of said radiating structures and a signal provided by said second signal feed circuit to ones of said second subsections of said radiating structures, wherein said phase shift is operable to elevationally steer a beam radiating from said radiation structures.

39. The method of claim 38, further comprising the step of:

adjusting said phase shift to provide adjustable beam steering.

40. The method of claim 39, wherein said step of adjusting said phase shift comprises the steps of:

providing a common signal feed path between said first and second signal feed circuits;

supplying a plurality of tap positions in said common signal feed path disposed to provide differing signal path lengths to said first and second signal feed circuits from a common input; and switchably coupling said common input and a tap position of said plurality of tap positions.

41. The method of claim 33, further comprising the step of:

subdividing each radiating structure into a first column having a first polarization and a second column having a second polarization, wherein said first signal feed circuit is coupled to said first columns and said second signal feed circuit is coupled to said second columns.

42. The method of claim 41, wherein said first and second signal feed circuits comprise Wilkinson and hybrid combiners coupled to provide a signal to interleaved radiating columns.

43. The method of claim 32, further comprising the steps of:

subdividing each radiating structure of said plurality into a first subsection and a second subsection; and introducing a phase shift between a signal provided by said first signal feed circuit to said first subsection and said signal provided by said first signal feed circuit to said second subsection, wherein said phase shift is operable to elevationally steer a beam radiating from said radiating structures.

44. A multibeam antenna system having a plurality of radiating columns spaced circumferentially around a center point, said antenna system comprising:

a first antenna feed ring having a first set of connectors disposed around an inner circumference and a second set of connectors disposed around an outer circumference, each connector of said second set being associated with a particular radiating column of said plurality, and each connector of said first set being in communication with predetermined connectors of said second set;

a second antenna feed ring having a third set of connectors disposed around an inner circumference and a fourth set of connectors disposed around an outer circumference, each connector of said fourth set being associated with a particular radiating column of said plurality, and each connector of said third set being in communication with predetermined connectors of said fourth set.

45. The antenna system of claim 44, wherein said first feed ring comprises a digital beam forming system and said second feed ring comprises an analogue beam forming system.

46. The antenna system of claim 44, wherein a first beam width of said multibeam antenna is a function of the number of said predetermined connectors of said second set of connectors of said first antenna feed ring in communication with a connector of said first set, and a second beam width of said multibeam antenna is a function of the number of said predetermined connectors of said fourth set of connectors of said second antenna feed ring in communication with a connector of said third set.

47. The antenna system of claim 44, wherein a connector of said second set of connectors of said first feed ring is associated with a same antenna column as a connector of said fourth set of connectors of said second feed ring.

48. The antenna system of claim 47, further comprising:

a combiner coupled to said connector of said second set of connectors of said first feed ring and to said connector of said fourth set of connectors of said second feed ring associated with said same antenna column, wherein multiple beam widths are simultaneously provided by said antenna, different ones of said multiple beam widths being associated with said first and second feed rings.

49. The antenna system of claim 47, further comprising:

signal delay means for providing a phase differential between a common signal provided to said first and second feed rings; and at least one subdivision of said radiating columns providing at least two column subsections, wherein said second set of connectors of said first feed ring are associated with a first subsection and said fourth set of connectors of said second feed ring are associated with a second subsection, and wherein said phase differential in said common signal is adapted to provide beam steering of an antenna beam.

50. The antenna system of claim 47, wherein each radiating column further comprises:

a first subcolumn having antenna elements disposed to provide a particular polarization, said second set of connectors of said first feed ring being associated therewith; and a second subcolumn having antenna elements disposed to provide a different polarization than said first subcolumn, said fourth set of connectors of said second feed ring being associated therewith, wherein polar diversity is realized by a signal being provided to said radiating column having antenna elements disposed to provide different polarity.

* * * * *

UNITED STATES PATENT AND TRADEMARK OFFICE

CERTIFICATE OF CORRECTION

PATENT NO. : 6,094,166
DATED : July 25, 2000
INVENTOR(S) : Martek et al.

It is certified that error appears in the above-identified patent and that said Letters Patent is hereby corrected as shown below:

Title page, column 1, lines 1-3:
Item [54] Title should read -- CONICAL OMNI-DIRECTIONAL COVERAGE MULTIPLE-BEAM ANTENNA WITH MULTIPLE FEED NETWORK --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*